US012629746B2

(12) United States Patent
Murai et al.

(10) Patent No.: US 12,629,746 B2
(45) Date of Patent: May 19, 2026

(54) REBAR TYING TOOL

(71) Applicant: MAKITA CORPORATION, Anjo (JP)

(72) Inventors: Yuki Murai, Anjo (JP); Kenji Kobayashi, Anjo (JP); Yuta Asakura, Anjo (JP); DucThuan Tran, Anjo (JP)

(73) Assignee: MAKITA CORPORATION, Anjo (JP)

( * ) Notice: Subject to any disclaimer, the term of this patent is extended or adjusted under 35 U.S.C. 154(b) by 369 days.

(21) Appl. No.: 18/335,435

(22) Filed: Jun. 15, 2023

(65) Prior Publication Data

US 2023/0405664 A1 Dec. 21, 2023

(30) Foreign Application Priority Data

Jun. 17, 2022 (JP) ..... 2022-098162

(51) Int. Cl.
*B21F 15/04* (2006.01)
*B65B 13/16* (2006.01)

(52) U.S. Cl.
CPC ..... *B21F 15/04* (2013.01); *B65B 13/16* (2013.01)

(58) Field of Classification Search
CPC ..... B21F 15/04; B65B 13/16; E04G 21/122; E04G 21/123
See application file for complete search history.

(56) References Cited

U.S. PATENT DOCUMENTS

| | | | | |
|---|---|---|---|---|
| 2005/0061389 | A1 | 3/2005 | Nakagawa et al. | |
| 2009/0126824 | A1 | 5/2009 | Nakagawa et al. | |
| 2018/0187432 | A1 | 7/2018 | Itagaki | |
| 2021/0002911 | A1* | 1/2021 | Asakura | B21F 15/04 |
| 2021/0148127 | A1* | 5/2021 | Itagaki | H02G 1/005 |

FOREIGN PATENT DOCUMENTS

| | | | |
|---|---|---|---|
| JP | 2004-59017 | A | 2/2004 |
| JP | 2004-142814 | A | 5/2004 |
| JP | 2019-014536 | A | 1/2019 |
| JP | 2021-193269 | A | 12/2021 |

OTHER PUBLICATIONS

Mar. 3, 2026 Office Action issued in Japanese Patent Application No. 2022-098162.

* cited by examiner

*Primary Examiner* — Debra M Sullivan
(74) *Attorney, Agent, or Firm* — Oliff PLC

(57) ABSTRACT

A rebar tying tool may be configured to tie rebars with a wire. The rebar tying tool may include: a first cutter; and a second cutter configured to cut the wire by moving relative to the first cutter. The second cutter may include: a cutting part configured to contact and cut the wire; a first connecting part connected to a first portion of the cutting part; and a second connecting part connected to a second portion of the cutting part, the second portion being different from the first portion.

13 Claims, 24 Drawing Sheets

REBAR TYING TOOL

REFERENCE TO RELATED APPLICATIONS

This application claims priority to Japanese Patent Application No. 2022-98162, filed on Jun. 17, 2022, the entire contents of which are hereby incorporated by reference into the present application.

TECHNICAL FIELD

The disclosure herewith relates to a rebar tying tool.

BACKGROUND ART

Japanese Patent Application Publication No. 2004-59017 describes a rebar tying tool. This rebar tying tool ties rebars using a wire. The rebar tying tool includes a first cutter and a second cutter configured to cut the wire by moving relative to the first cutter. The second cutter includes a cutting part configured to contact and cut the wire and a first connecting part connected to a first portion of the cutting part.

DESCRIPTION

The cutting part receives a reaction force from the wire when it cuts the wire. In the above rebar tying tool, when the cutting part receives the reaction force from the wire, stress concentrates at the cutting part, the first connecting part, and the vicinity. Due to this, the second cutter may be damaged. The disclosure herein discloses art to suppress damage to a second cutter.

A rebar tying tool disclosed herein may be configured to tie rebars with a wire. The rebar tying tool may comprise: a first cutter; and a second cutter configured to cut the wire by moving relative to the first cutter. The second cutter may comprise: a cutting part configured to contact and cut the wire; a first connecting part connected to a first portion of the cutting part; and a second connecting part connected to a second portion of the cutting part, the second portion being different from the first portion.

According to the above configuration, the cutting part is connected to the first connecting part and the second connecting part. Thus, when the cutting part receives a reaction force from the wire upon cutting the same, stress generated therefrom is dispersed to the cutting part, the first connecting part and the vicinity thereof, and to the cutting part, the second connecting part and the vicinity thereof. Due to this, the second cutter can be suppressed from being damaged.

A rebar tying tool disclosed herein may be configured to tie rebars with a wire. The rebar tying tool may comprise: a housing; and a cutter configured to cut the wire by being rotated relative to the housing. The cutter may comprise: a cutting part configured to contact and cut the wire, a first supporting part configured to support one end of the cutting part such that the one end of the cutting part is rotatable relative to the housing, and a second supporting part configured to support another end of the cutting part such that the other end of the cutting part is rotatable relative to the housing. The first supporting part and the second supporting part may receive a reaction force which the cutting part receives from the wire when the cutting part cuts the wire.

According to the above configuration, since the first supporting part and the second supporting part receive the reaction force which the cutting part receives from the wire when the cutting part cuts the wire, the stress is dispersed to the cutting part, the first supporting part and the vicinity thereof, and to the cutting part, the second supporting part, and the vicinity thereof. Due to this, the cutter can be suppressed from being damaged.

A rebar tying tool disclosed herein may be configured to tie rebars with a wire. The rebar tying tool may comprise: a first cutter; and a second cutter configured to cut the wire by moving relative to the first cutter. The second cutter may comprise: a cutting part configured to contact and cut the wire; a connecting part connected to the cutting part; and at least one coupling part. One of the cutting part and the connecting part may comprise at least one receiving part recessed toward inside of the one of the cutting part and the connecting part. The connecting part may be connected to the cutting part by each of the at least one receiving part receiving corresponding one of the at least one coupling part.

According to the above configuration, when the cutting part receives the reaction force from the wire upon cutting the same, the stress is dispersed to a boundary region between the coupling part and the receiving part. Due to this, the second cutter can be suppressed from being damaged.

Figure 6:
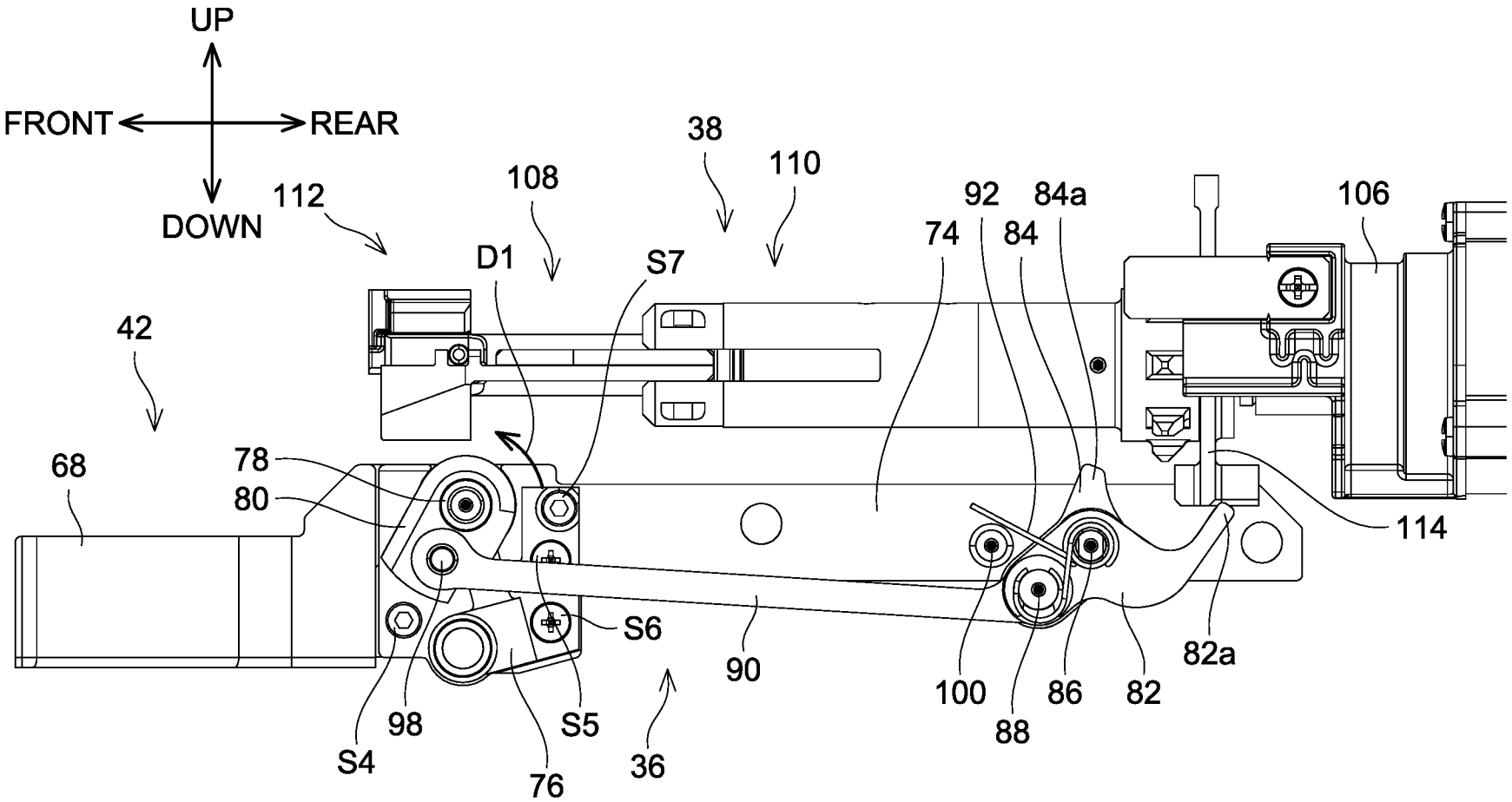

FIG. 6 is a side view of a cutting unit 36 and a twisting unit 38 before the cutting unit 36 of the first embodiment cuts a wire W.

Figure 7:
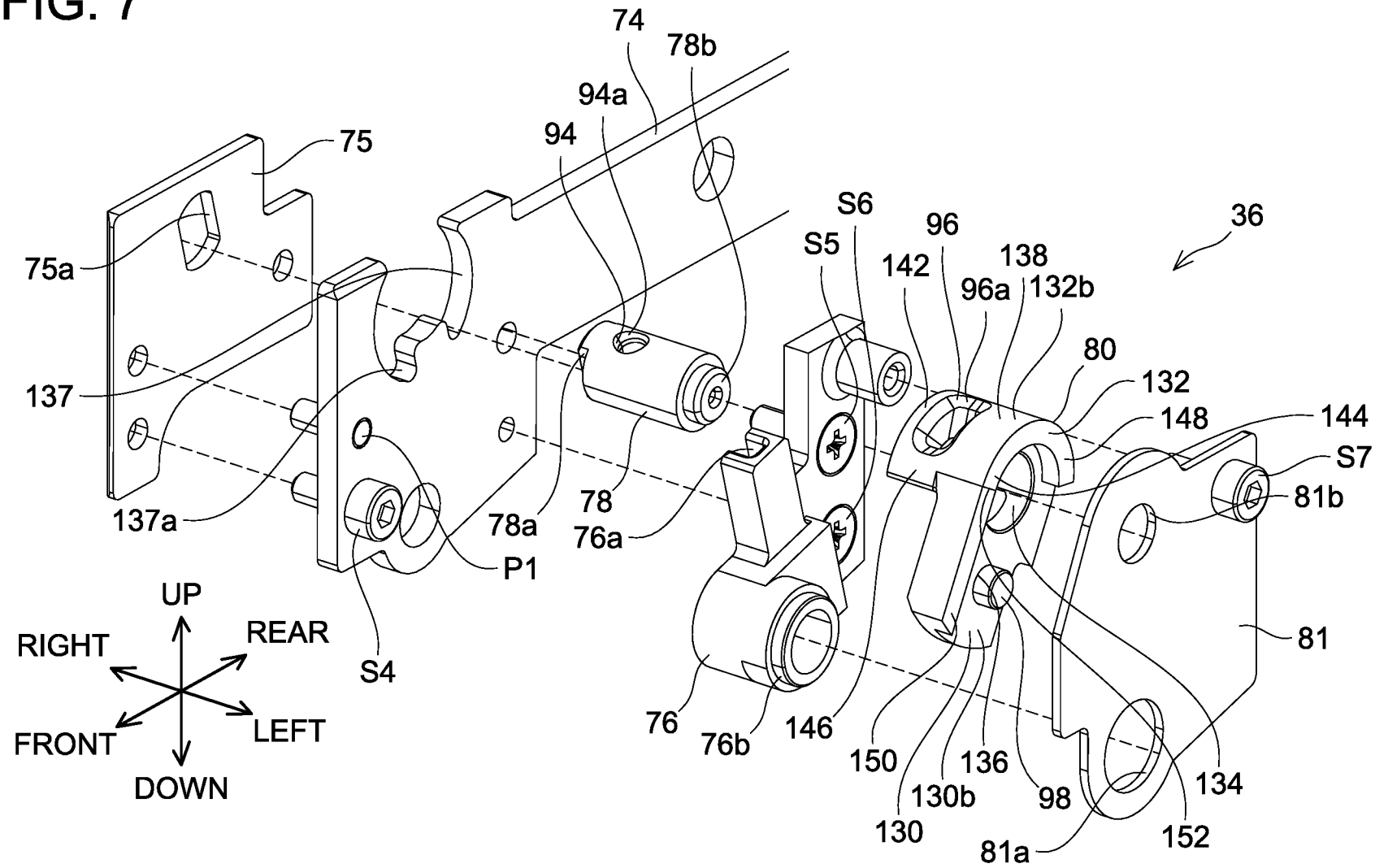

FIG. 7 is a disassembled perspective view of the cutting unit 36 of the first embodiment at the front end of the cutting unit 36 and its vicinity.

Figure 8:
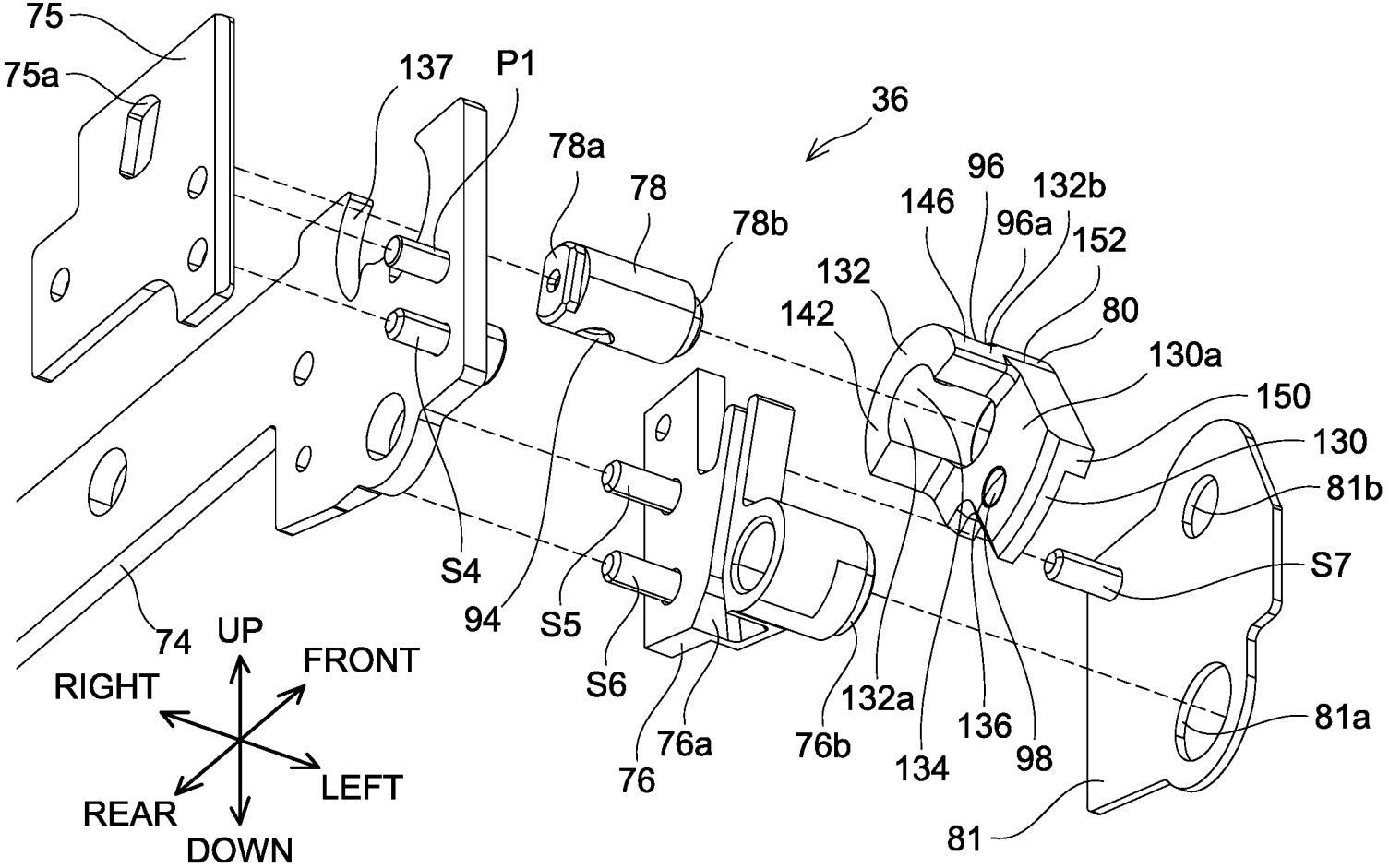

FIG. 8 is a disassembled perspective view of the cutting unit 36 of the first embodiment at the front end of the cutting unit 36 and its vicinity.

Figure 9:
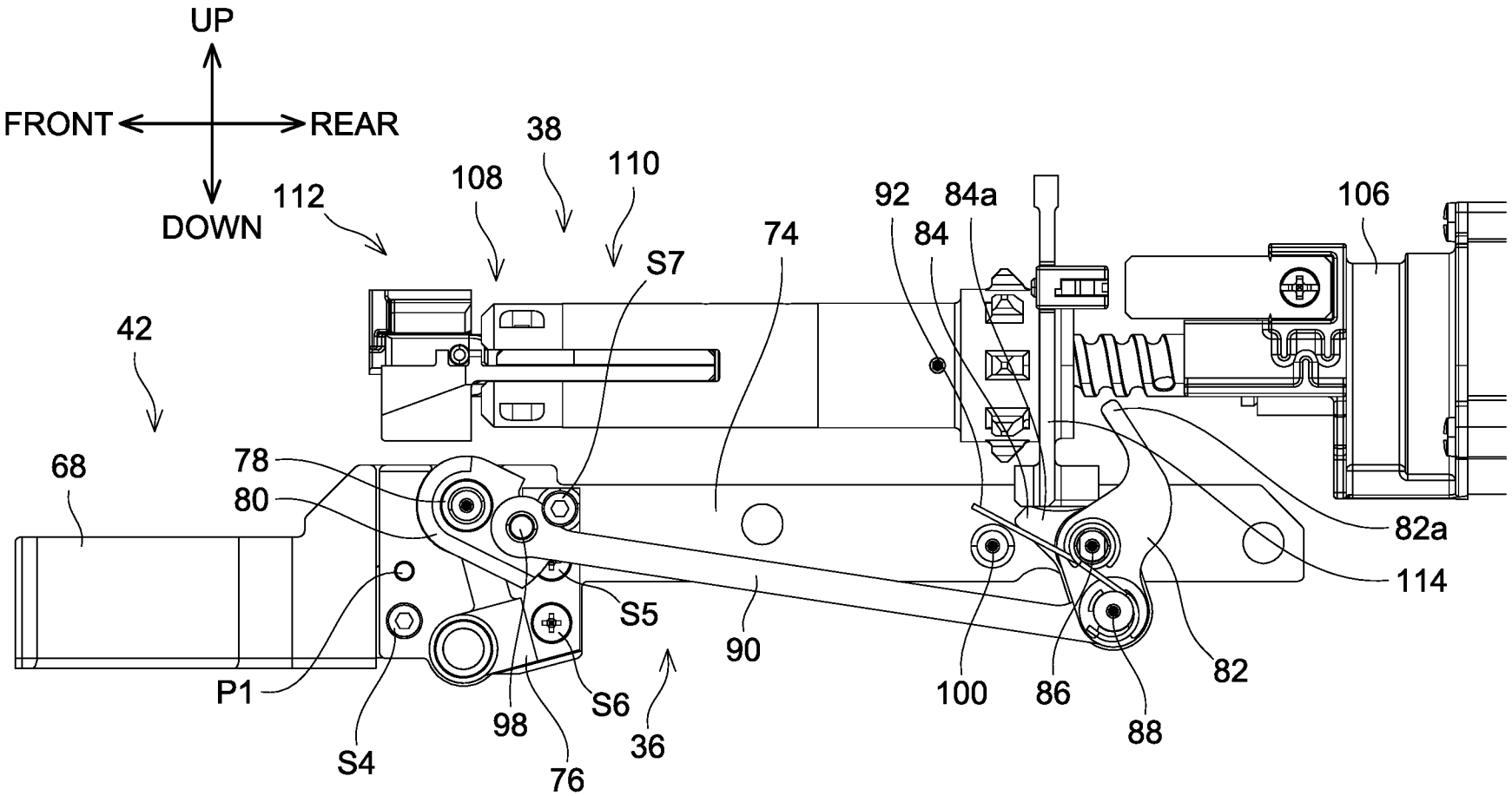

FIG. 9 is a side view of the cutting unit 36 and the twisting unit 38 after the cutting unit 36 of the first embodiment cut the wire W.

Figure 10:
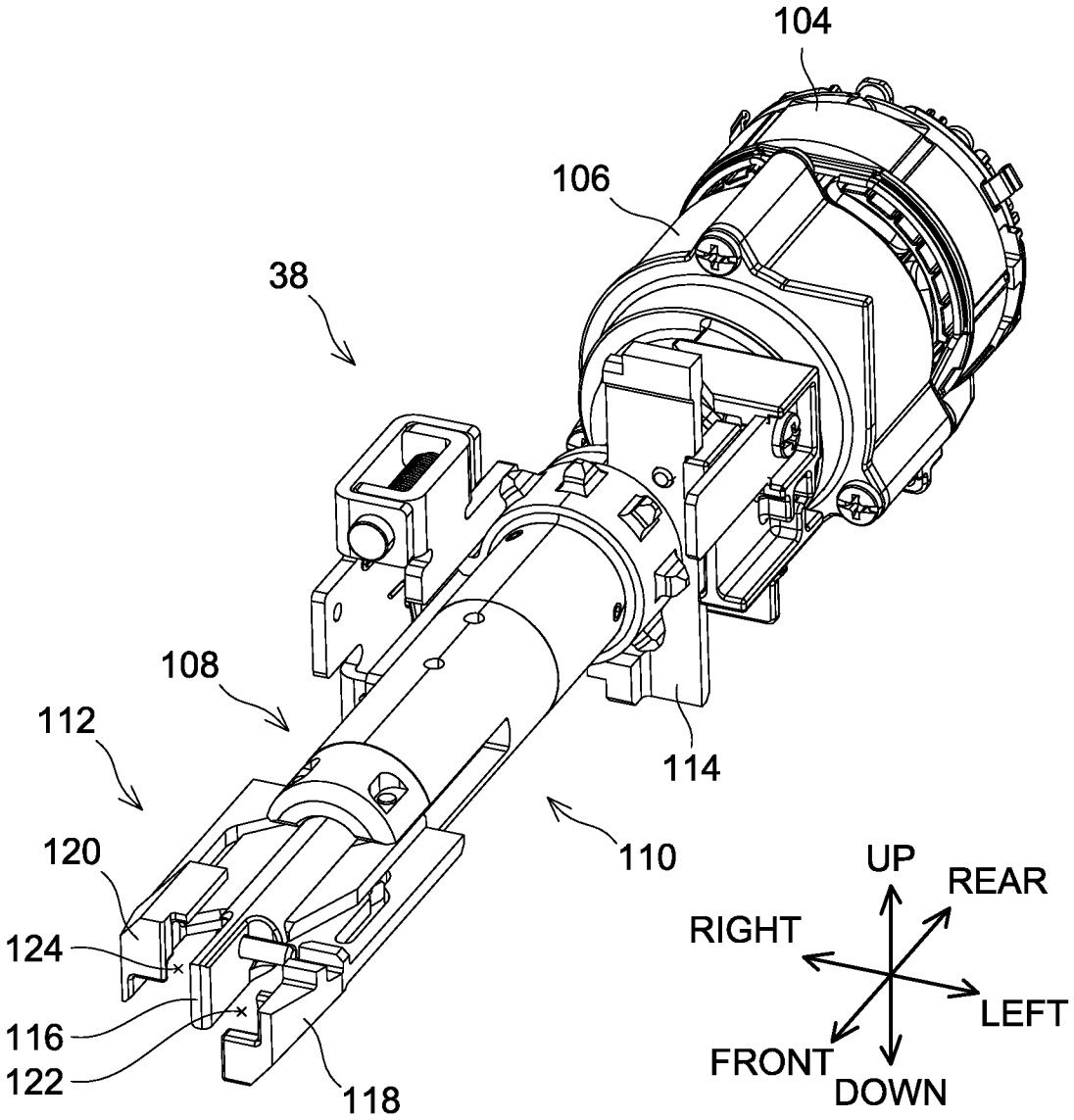

FIG. 10 is a perspective view of the twisting unit 38 of the first embodiment.

Figure 11:
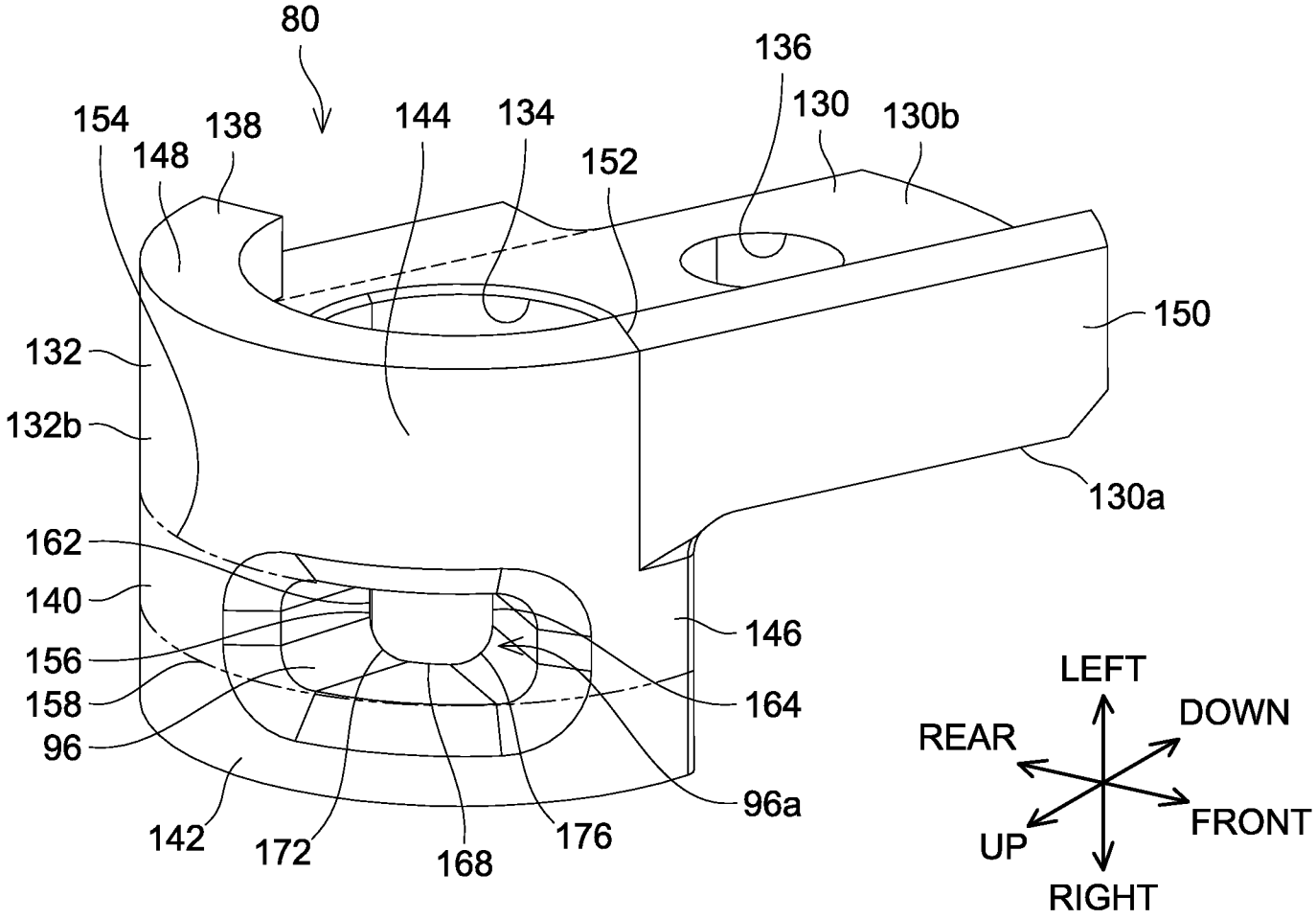

FIG. 11 is a perspective view of a second cutter 80 of the first embodiment.

Figure 12:
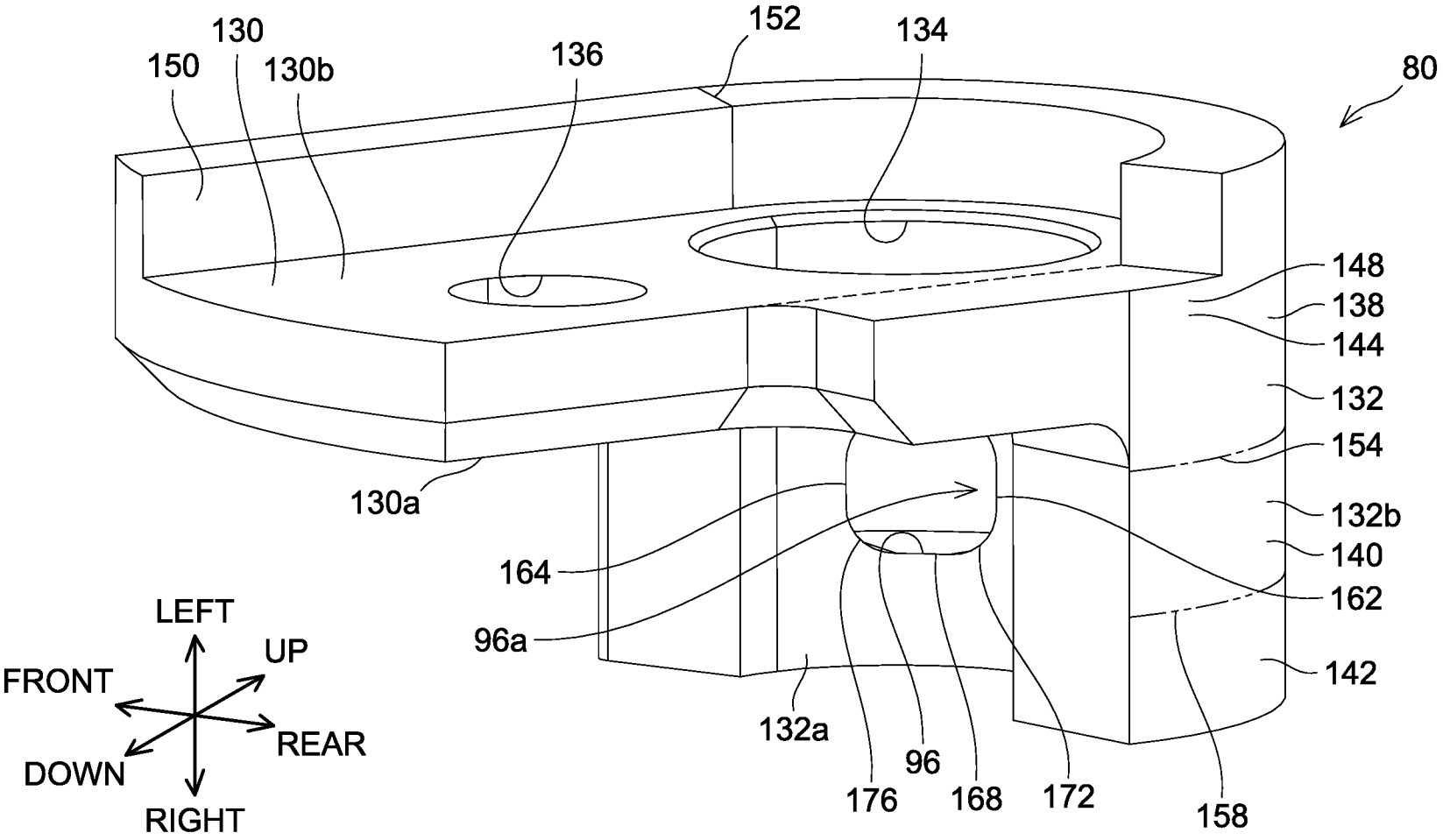

FIG. 12 is a perspective view of the second cutter 80 of the first embodiment.

Figure 13:
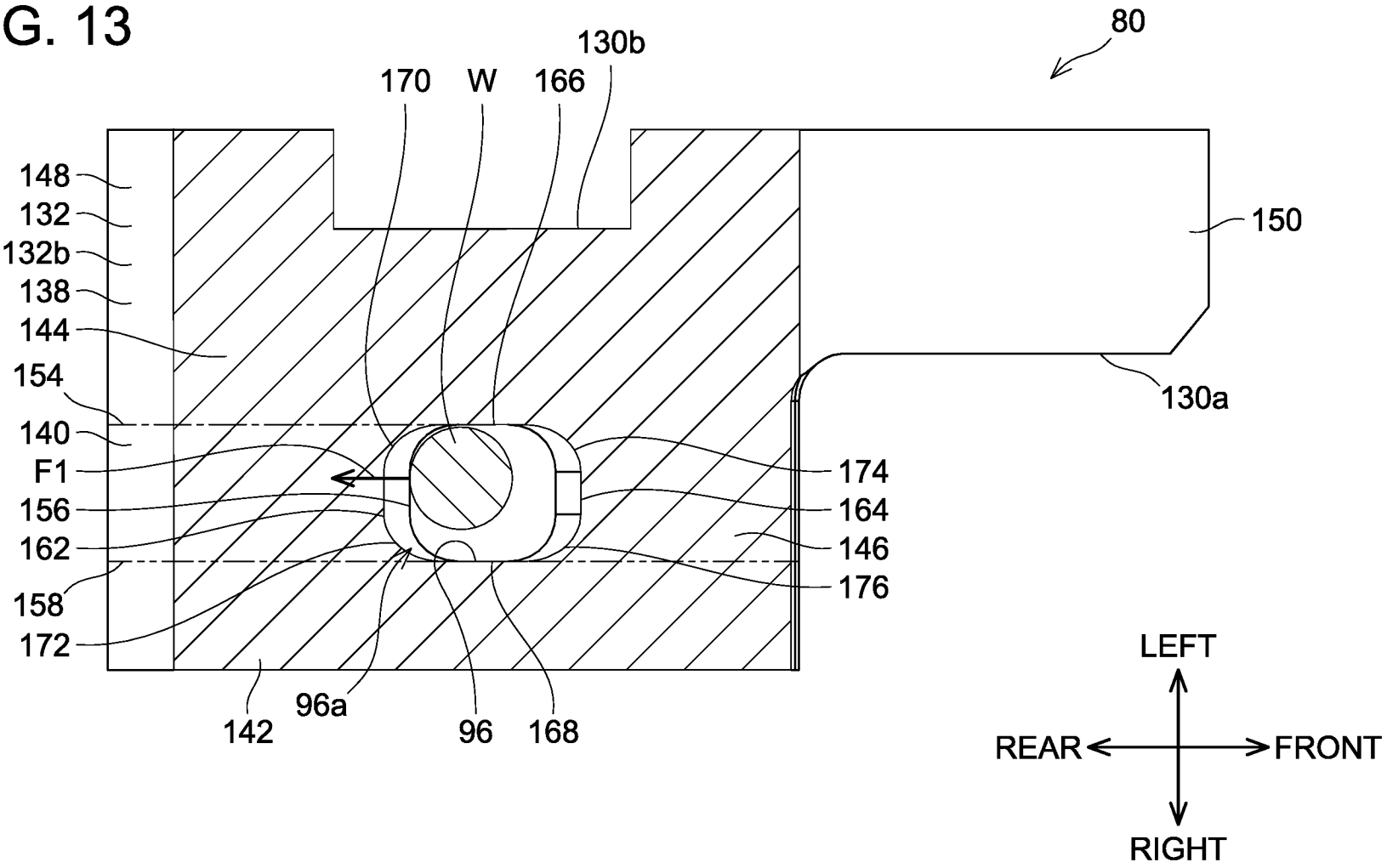

FIG. 13 is a cross-sectional view of the second cutter 80 of the first embodiment.

Figure 14:
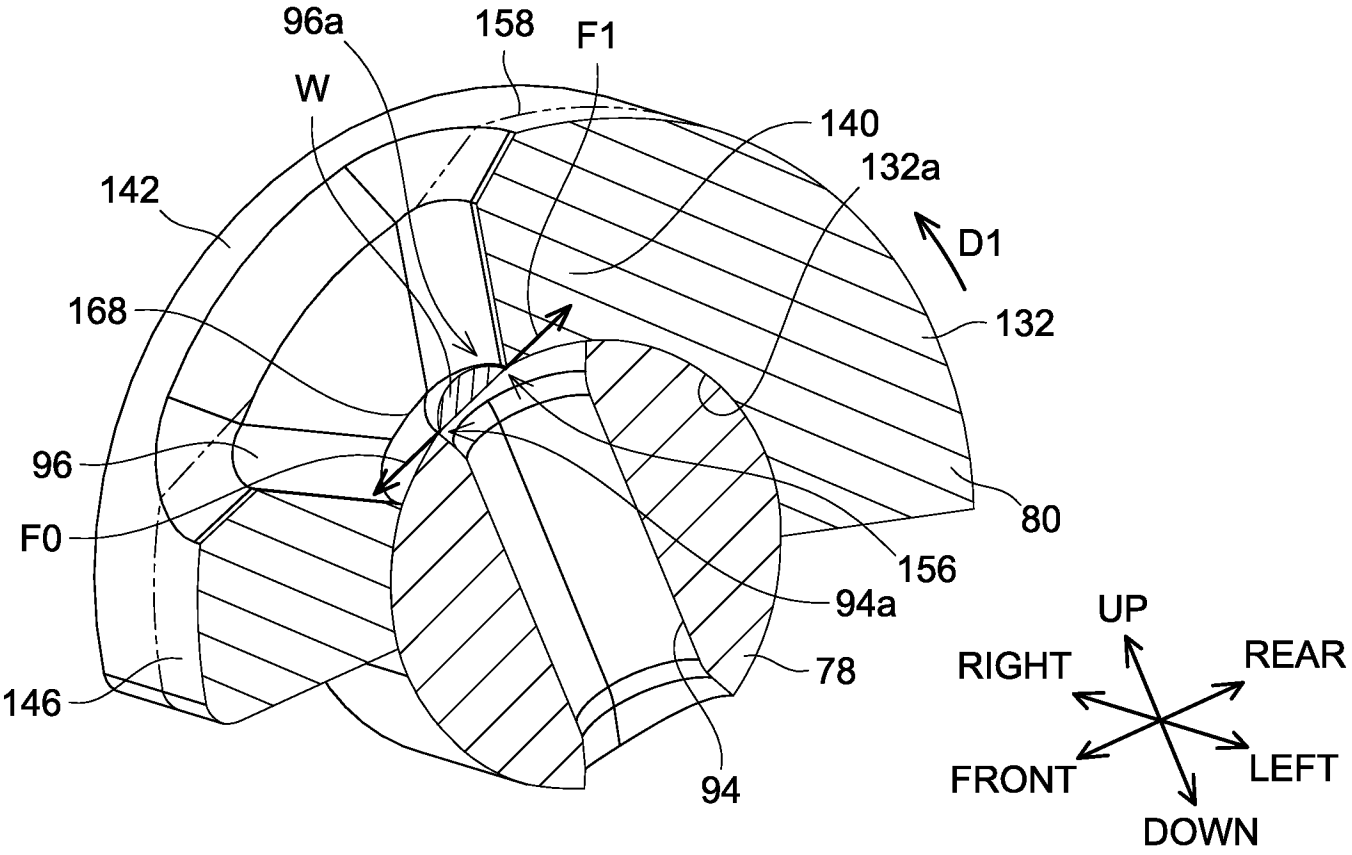

FIG. 14 is a cross-sectional perspective view of a first cutter 78 and the second cutter of the first embodiment.

Figure 15:
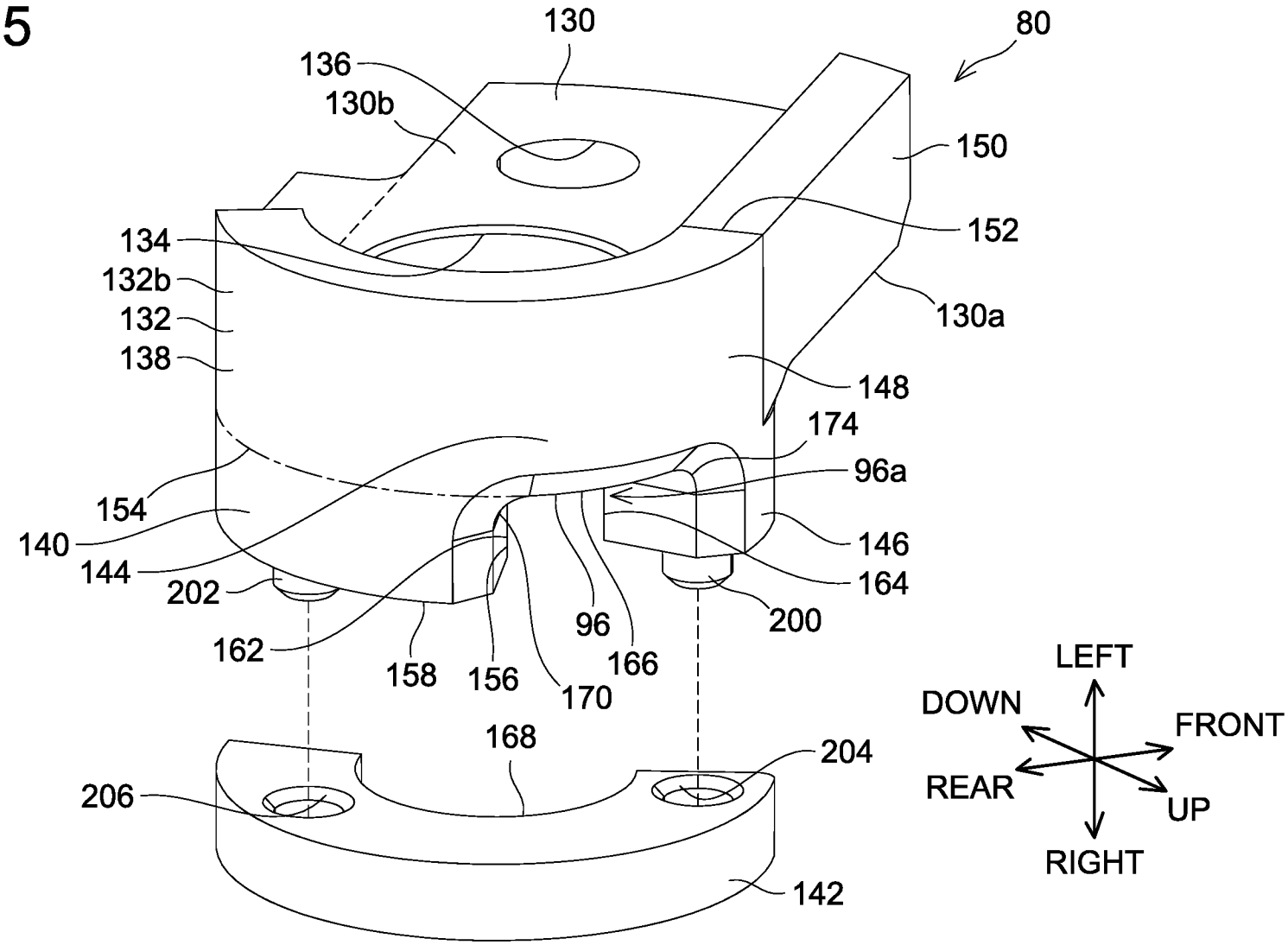

FIG. 15 is a disassembled perspective view of a second cutter 80 of a second embodiment.

Figure 16:
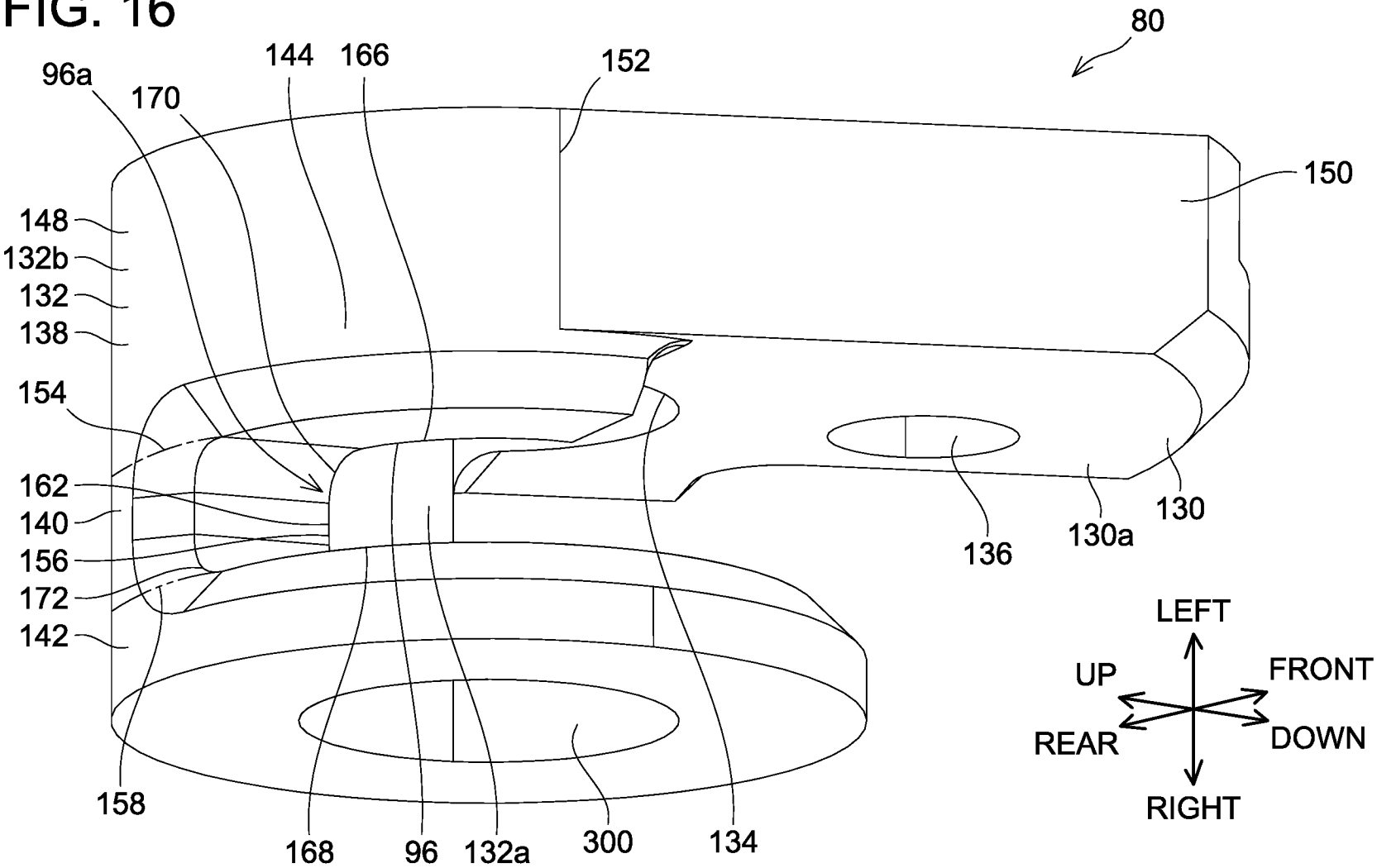

FIG. 16 is a perspective view of a second cutter 80 of a third embodiment.

Figure 17:
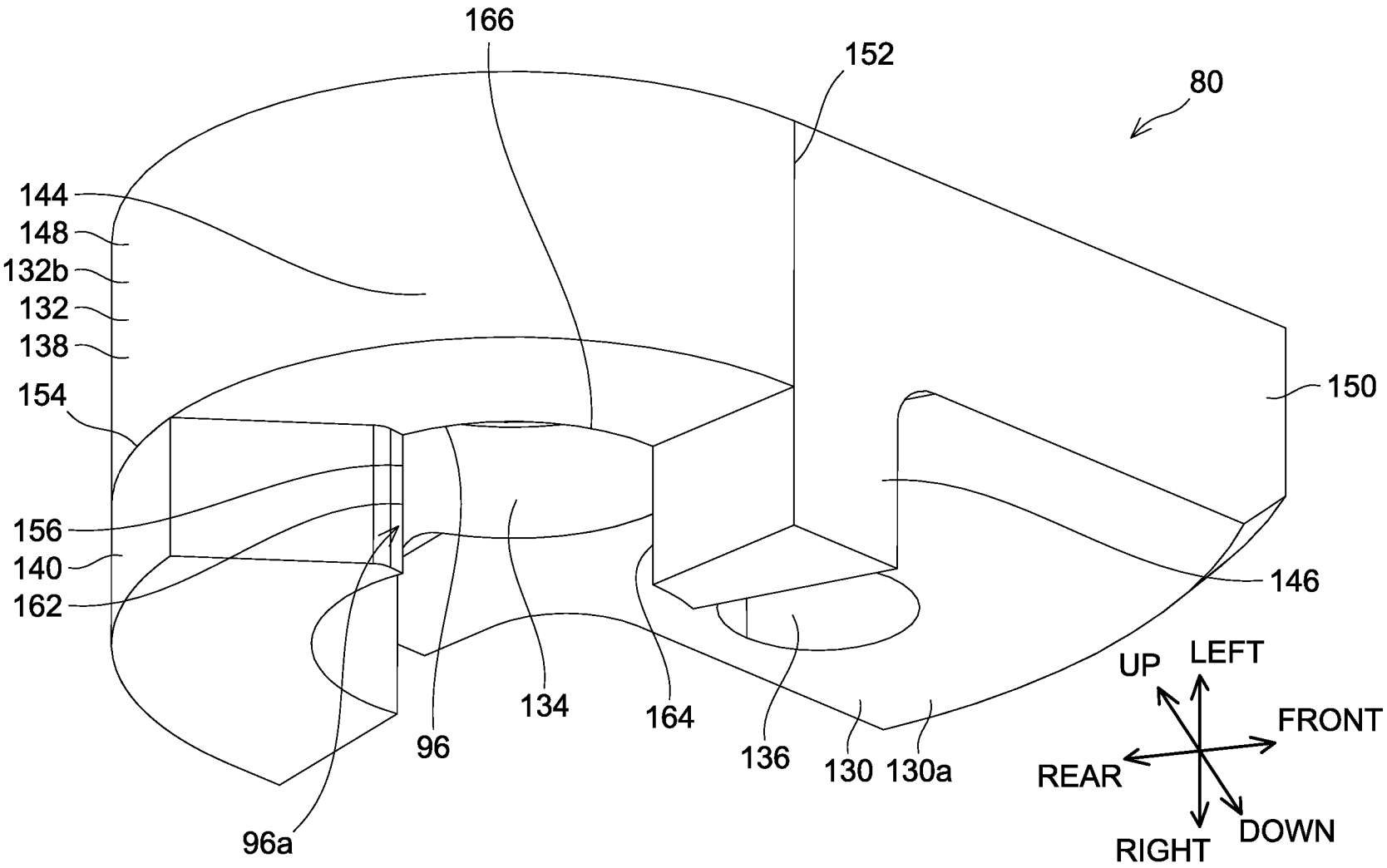

FIG. 17 is a perspective view of a second cutter 80 of a fourth embodiment.

Figure 18:
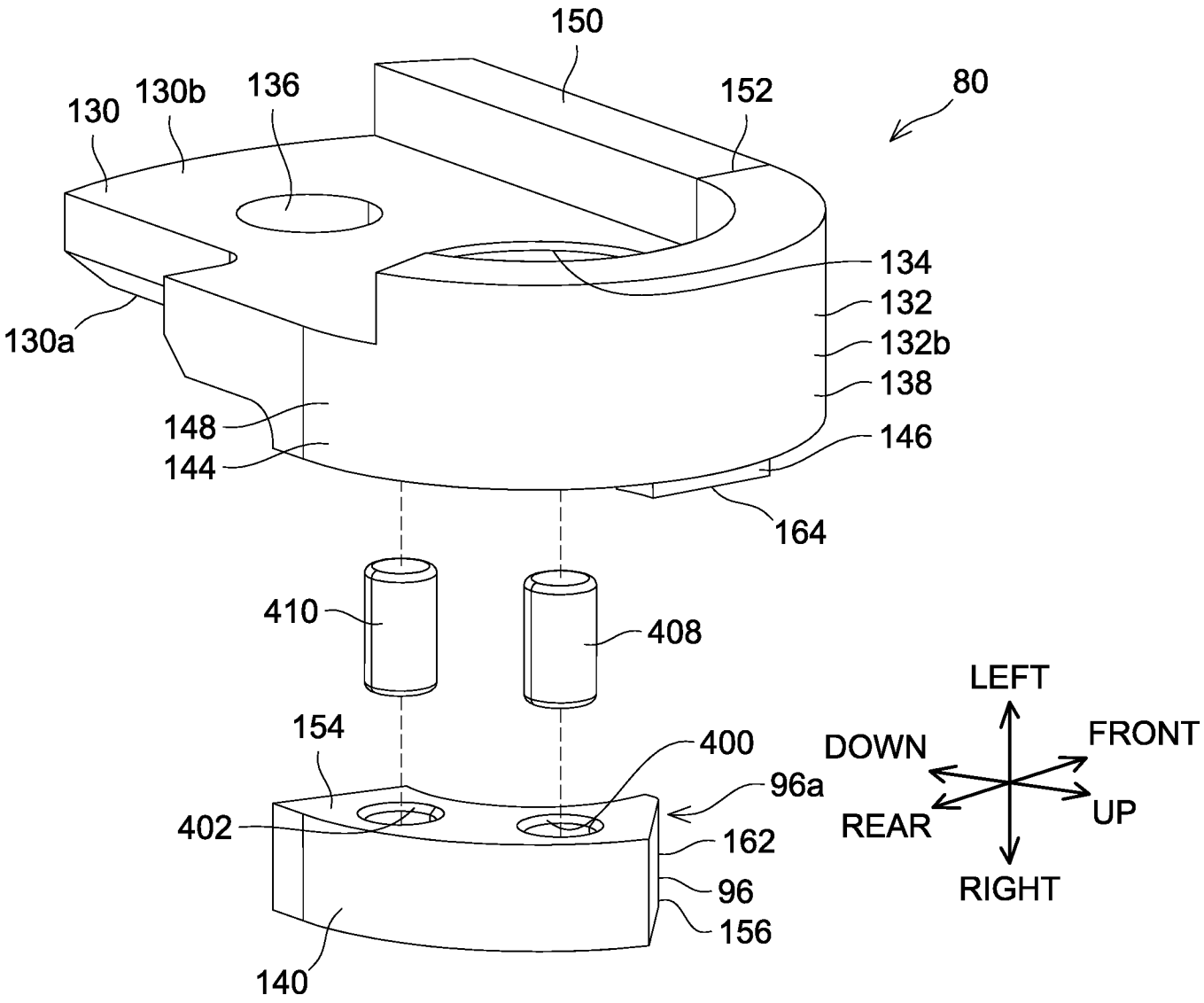

FIG. 18 is a disassembled perspective view of the second cutter 80 of the fourth embodiment.

Figure 19:
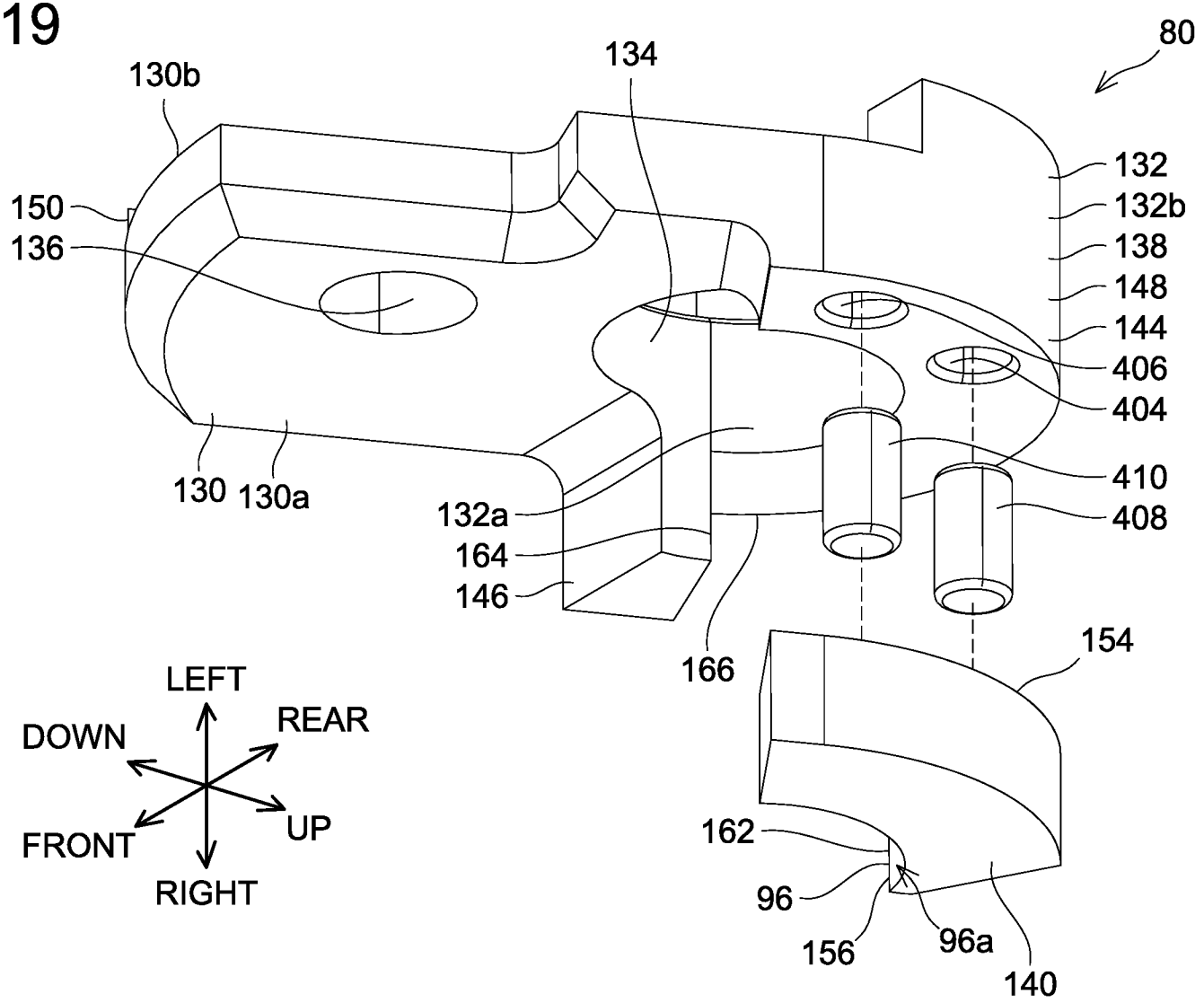

FIG. 19 is a disassembled perspective view of the second cutter 80 of the fourth embodiment.

Figure 20:
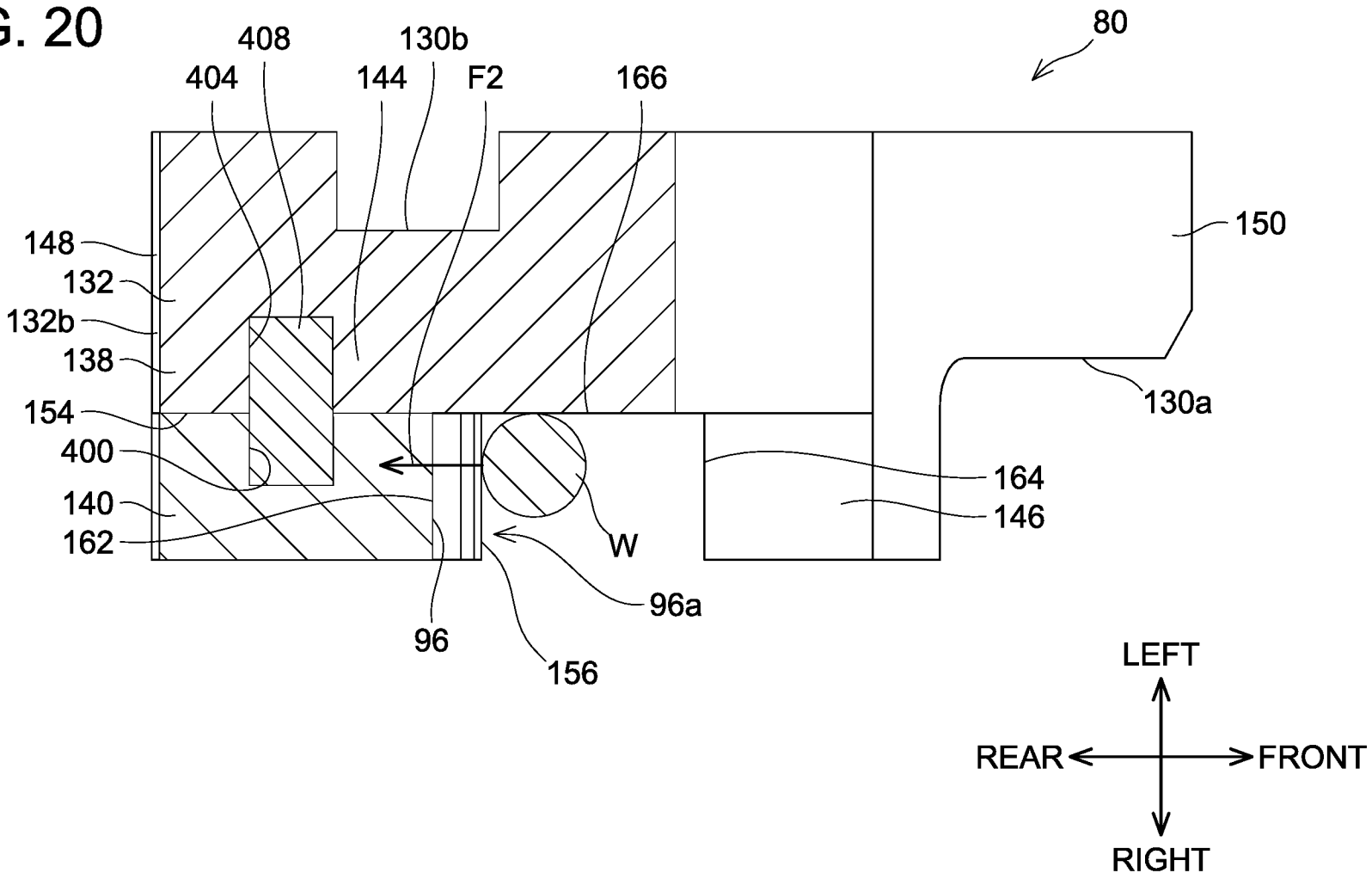

FIG. 20 is a cross-sectional view of the second cutter 80 of the fourth embodiment.

Figure 21:
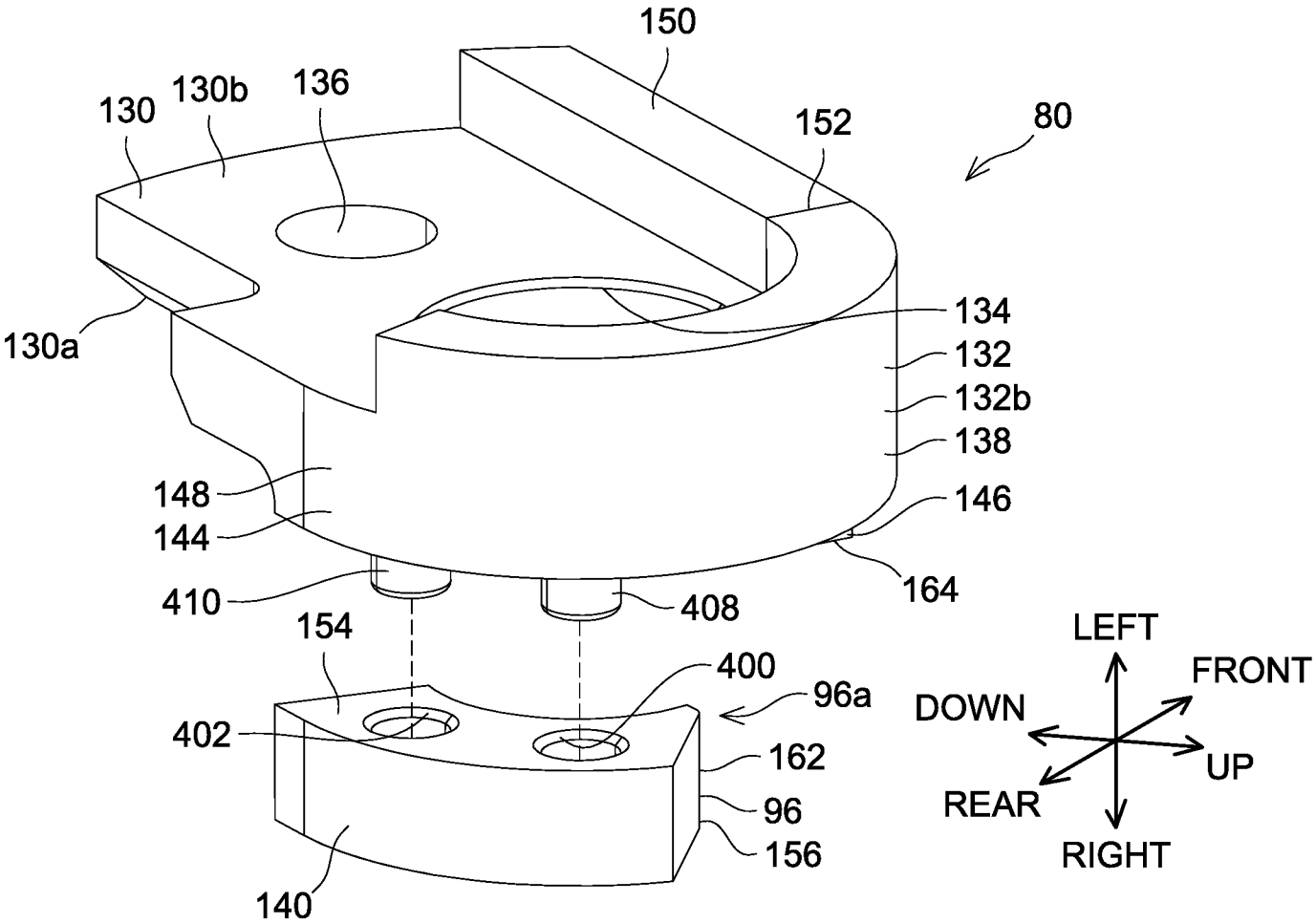

FIG. 21 is a disassembled perspective view of a second cutter 80 of a fifth embodiment.

Figure 22:
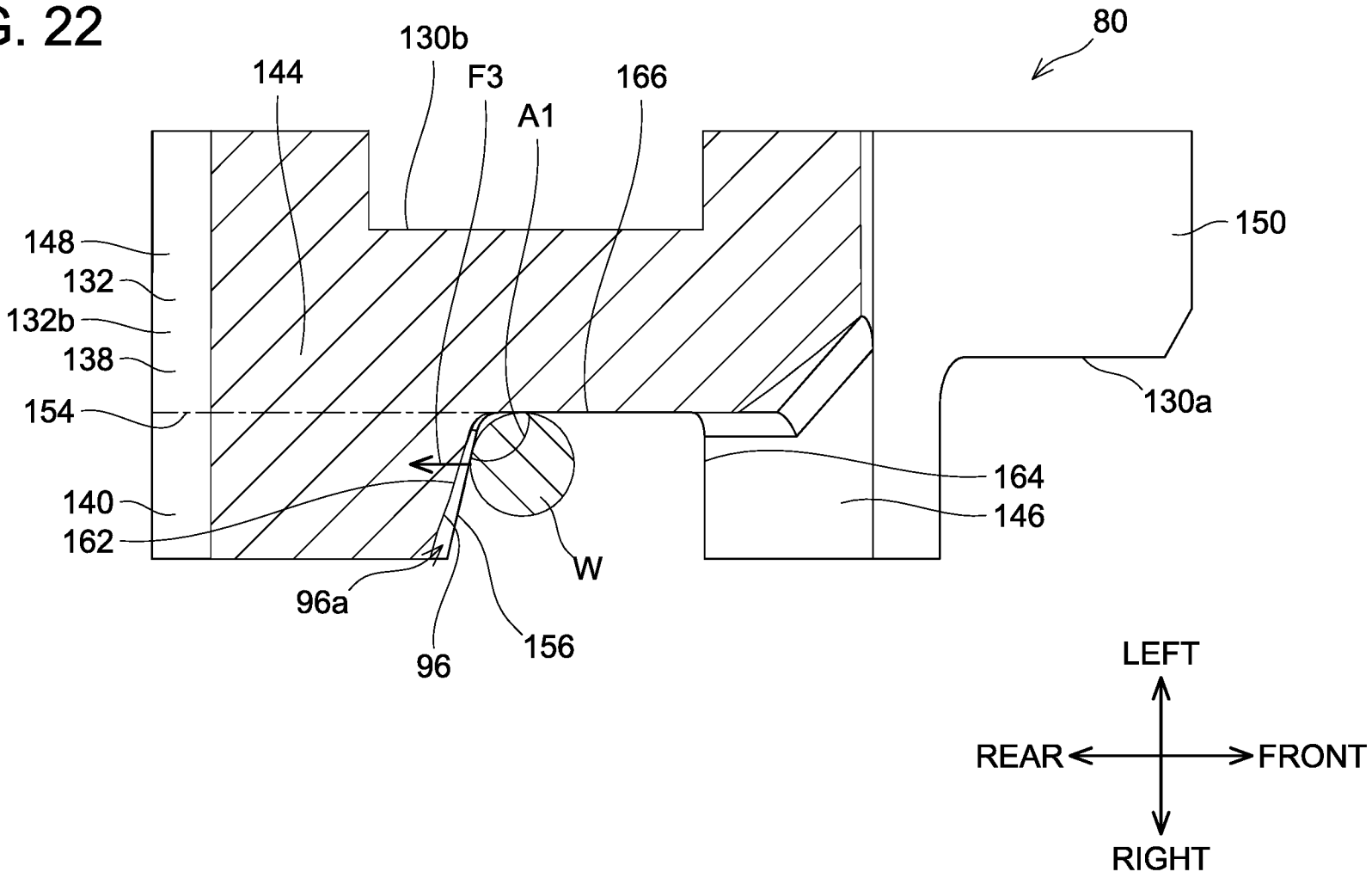

FIG. 22 is a cross-sectional view of a second cutter 80 of a sixth embodiment.

Figure 23:
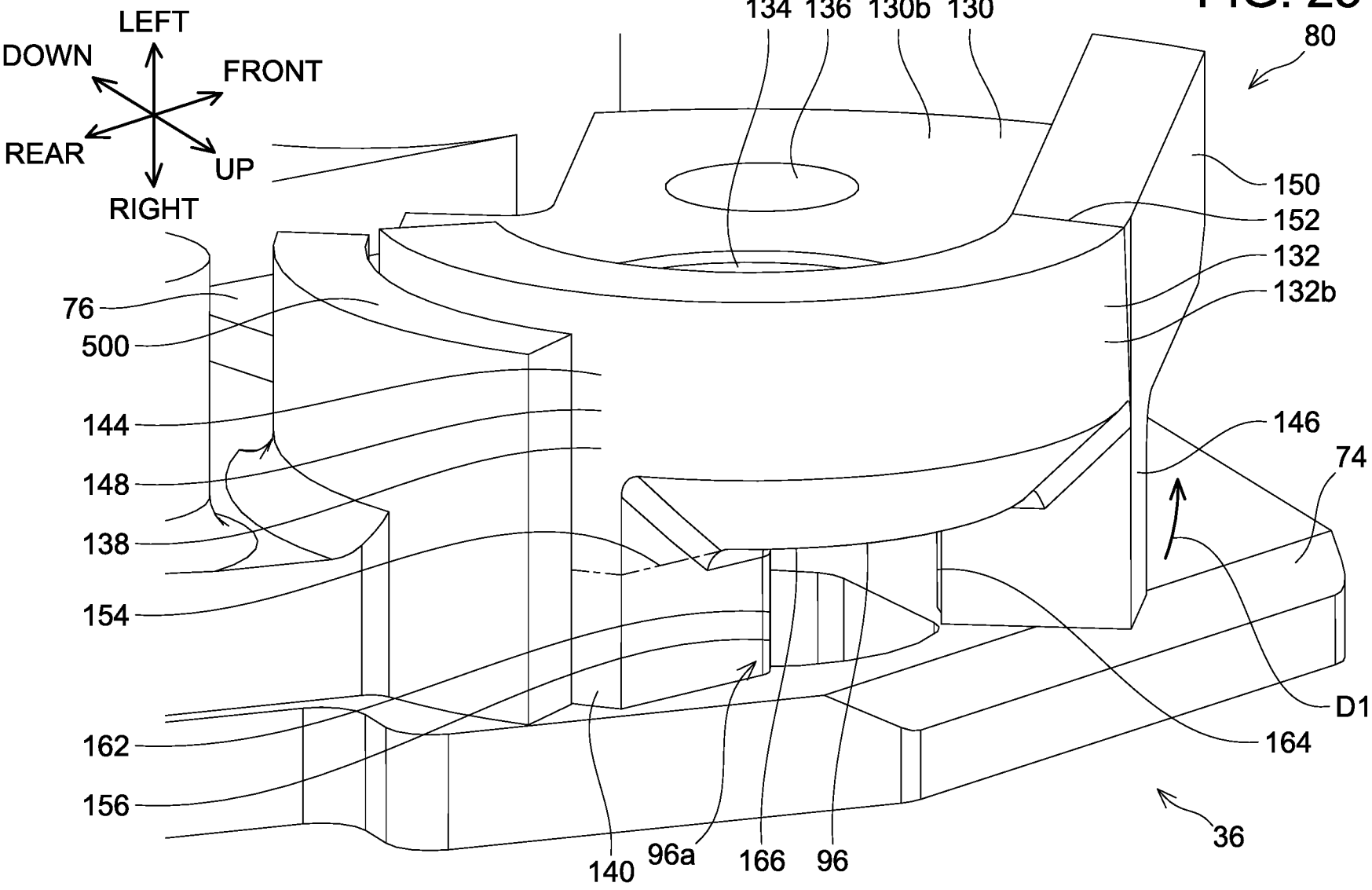

FIG. 23 is a perspective view of a base member 74, a guide member 76, a second cutter 80, and a deformation-restricting wall 500 of a seventh embodiment.

Figure 24:
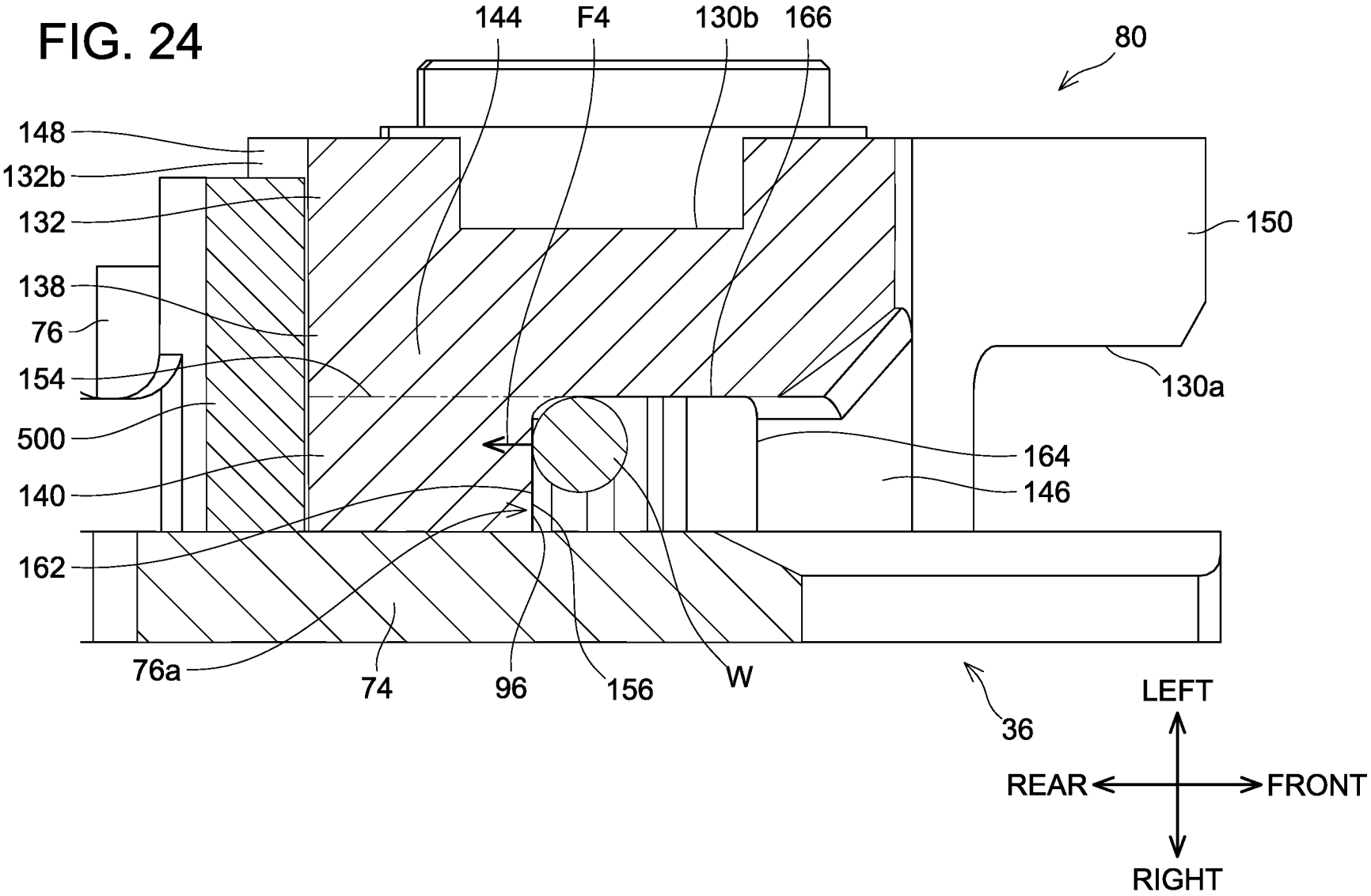

FIG. 24 is a cross-sectional view of the base member 74, the guide member 76, the second cutter 80, and the deformation-restricting wall 500 of the seventh embodiment.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved rebar tying tools, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

A rebar tying tool disclosed herein may be configured to tie rebars with a wire. The rebar tying tool may comprise: a first cutter; and a second cutter configured to cut the wire by moving relative to the first cutter. The second cutter may comprise: a cutting part configured to contact and cut the wire; a first connecting part connected to a first portion of the cutting part; and a second connecting part connected to a second portion of the cutting part, the second portion being different from the first portion.

In one or more embodiments, the first portion of the cutting part may be disposed at one end of the cutting part. The second portion of the cutting part may be disposed at another end of the cutting part, the other end being opposite the one end.

As compared to the configuration in which the first portion of the cutting part is not disposed at the one end of the cutting part and the second portion of the cutting part is not disposed at the other end of the cutting part, the entire second cutter can be made compact.

In one or more embodiments, the second cutter may further comprise a cutting hole defined by the cutting part, the first connecting part, and the second connecting part and constituting a through hole. The cutting part may be configured to cut the wire inserted into the cutting hole.

According to the above configuration, when the cutting part cuts the wire, stress can be suppressed from concentrating at the first connecting part or at the second connecting part. Due to this, the second cutter can further be suppressed from being damaged.

In one or more embodiments, a cross section of the cutting hole may comprise: a first edge arranged in the cutting part and configured to contact and cut the wire, a second edge arranged in the first connecting part; and a third edge connecting the first edge and the second edge. The third edge may be curved.

With the configuration in which the cross section of the cutting hole does not have the third edge, stress concentrates at a connecting portion between the first and second edges when the cutting part cuts the wire. According to the above configuration, when the cutting part cuts the wire, the stress is dispersed at the curved third edge. Due to this, the second cutter can further be suppressed from being damaged.

In one or more embodiments, the second edge may extend straight.

With the configuration in which the second edge is bent, the stress concentrates at its bent portion and its vicinity when the cutting part cuts the wire. According to the above configuration, the stress can be suppressed from concentrating at a certain portion of the second edge and its vicinity when the cutting part cuts the wire. Due to this, the second cutter can further be suppressed from being damaged.

In one or more embodiments, the second edge may be substantially perpendicular to the first edge.

According to the above configuration, the wire can be suppressed from moving on the first edge when the cutting part cuts the wire.

In one or more embodiments, the second connecting part may be connected to the first connecting part.

According to the above configuration, even when the cutting part receives a reaction force from the wire when it cuts the wire, the second cutter can further be suppressed from being damaged.

In one or more embodiments, the cutting part, the first connecting part, and the second connecting part may be integrally formed.

According to the above configuration, the configurations of the cutting part, the first connecting part, and the second connecting part can be suppressed from becoming complicated.

In one or more embodiments, the second cutter may be configured to rotate relative to the first cutter.

According to the above configuration, as compared to the case in which the second cutter slides linearly relative to the first cutter, a space in which the first and second cutters are arranged can be made small.

A rebar tying tool disclosed herein may be configured to tie rebars with a wire. The rebar tying tool may comprise: a housing; and a cutter configured to cut the wire by being rotated relative to the housing. The cutter may comprise: a cutting part configured to contact and cut the wire, a first supporting part configured to support one end of the cutting part such that the one end of the cutting part is rotatable relative to the housing, and a second supporting part configured to support another end of the cutting part such that the other end of the cutting part is rotatable relative to the housing. The first supporting part and the second supporting part may receive a reaction force which the cutting part receives from the wire when the cutting part cuts the wire.

A rebar tying tool disclosed herein may be configured to tie rebars with a wire. The rebar tying tool may comprise: a first cutter; and a second cutter configured to cut the wire by moving relative to the first cutter. The second cutter may comprise: a cutting part configured to contact and cut the wire; a connecting part connected to the cutting part; and at least one coupling part. One of the cutting part and the connecting part may comprise at least one receiving part recessed toward inside of the one of the cutting part and the connecting part. The connecting part may be connected to the cutting part by each of the at least one receiving part receiving corresponding one of the at least one coupling part.

In one or more embodiments, the other of the cutting part and the connecting part may be integrally formed with the at least one coupling part. Each of the at least one coupling part may protrude outward from the other of the cutting part and the connecting part.

According to the above configuration, the configuration of the second cutter can be suppressed from becoming complicated.

In one or more embodiments, the cutting part may comprise a cutting surface configured to contact and cut the wire. The connecting part may comprise a supporting surface connected to the cutting surface and substantially perpendicular to the cutting surface.

According to the above configuration, the wire can be suppressed from moving on the cutting surface when the cutting part cuts the wire.

First Embodiment

Figure 1:
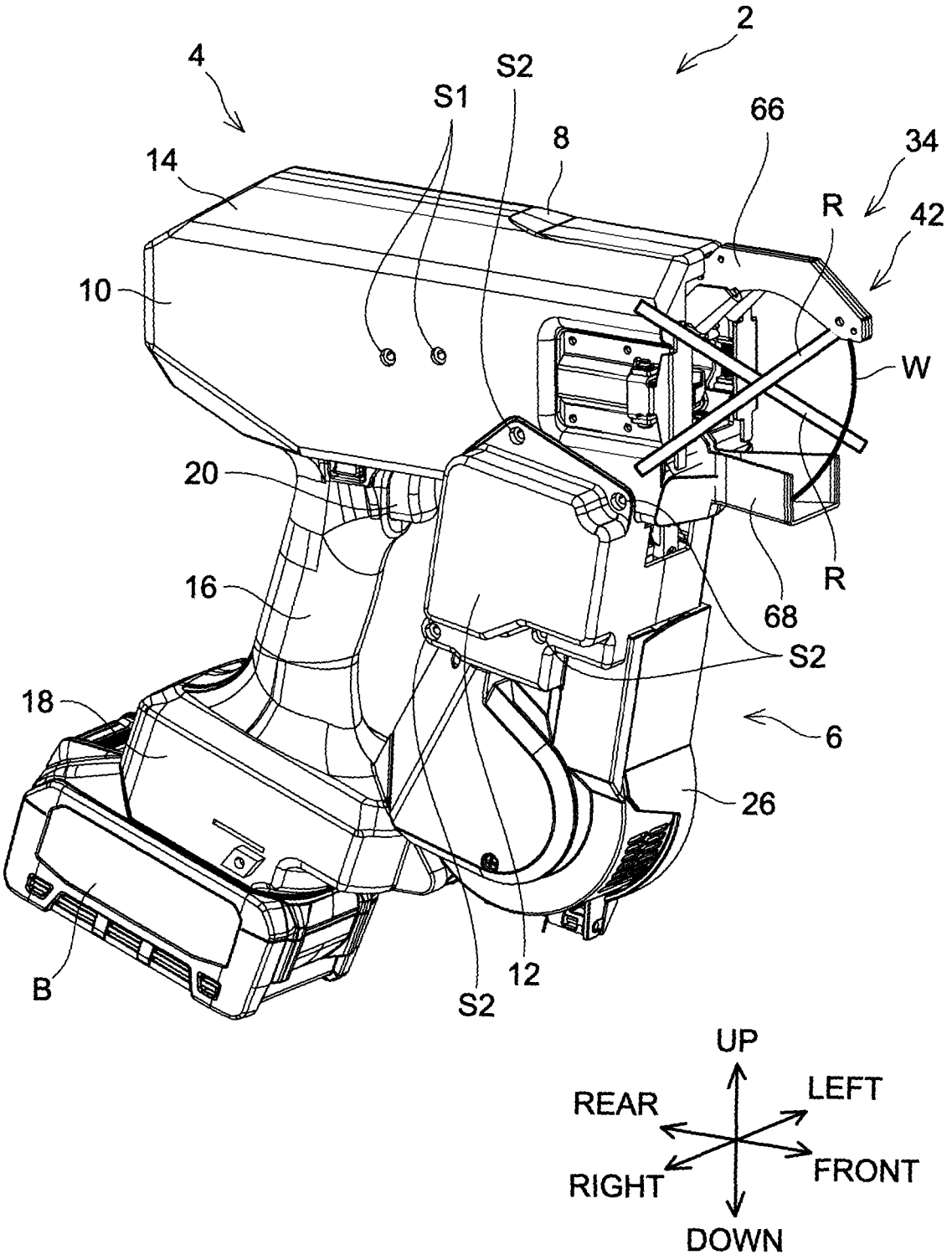
FIG. 1 is a perspective view of a rebar tying tool 2 of a first embodiment viewed from the front right upper side.

As shown in FIG. 1, a rebar tying tool 2 is configured to tie a plurality of rebars R using a wire W. In the rebar tying tool 2, wires W having various diameters (ranging from φ0.5 mm to φ2.5 mm, for example) are used in accordance with a diameter of the rebars R that are used. For example, when rebars R having a small diameter such as 16 mm or less (φ16 mm, for example) are to be tied, a wire W having a diameter of 1.6 mm or less (φ0.8 mm, for example) is used, and when rebars R having a large diameter greater than 16 mm (φ25 or 32 mm, for example) are to be tied, a wire W having a diameter greater than 1.6 mm (φ2.0 mm, for example) is used. Hereinbelow, a longitudinal direction of the twisting unit 38 (see FIG. 3) will be termed a front-rear direction, a direction perpendicular to the front-rear direction will be termed an up-down direction, and a direction perpendicular to the front-rear direction and the up-down direction will be termed a left-right direction.

The rebar tying tool 2 comprises a body 4, a reel holder 6, and a battery pack B. The body 4 comprises a left body 8 defining an outer shape of a left half of the body 4, a right body 10 defining an outer shape of a right half of the body 4, and a motor cover 12 attached to an outer side of the right body 10. The left body 8 and the right body 10 are fixed by a plurality of screws S1. The right body 10 and the motor cover 12 are fixed by a plurality of screws S2.

The body 4 comprises a body housing 14, a grip 16, and a battery receiving part 18. The body housing 14, the grip 16, and the battery receiving part 18 are integrally formed. The grip 16 is configured to be gripped by a user. A trigger 20 is arranged at a front upper portion of the grip 16. The battery pack B can be detachably attached to the battery receiving part 18.

Figure 2:
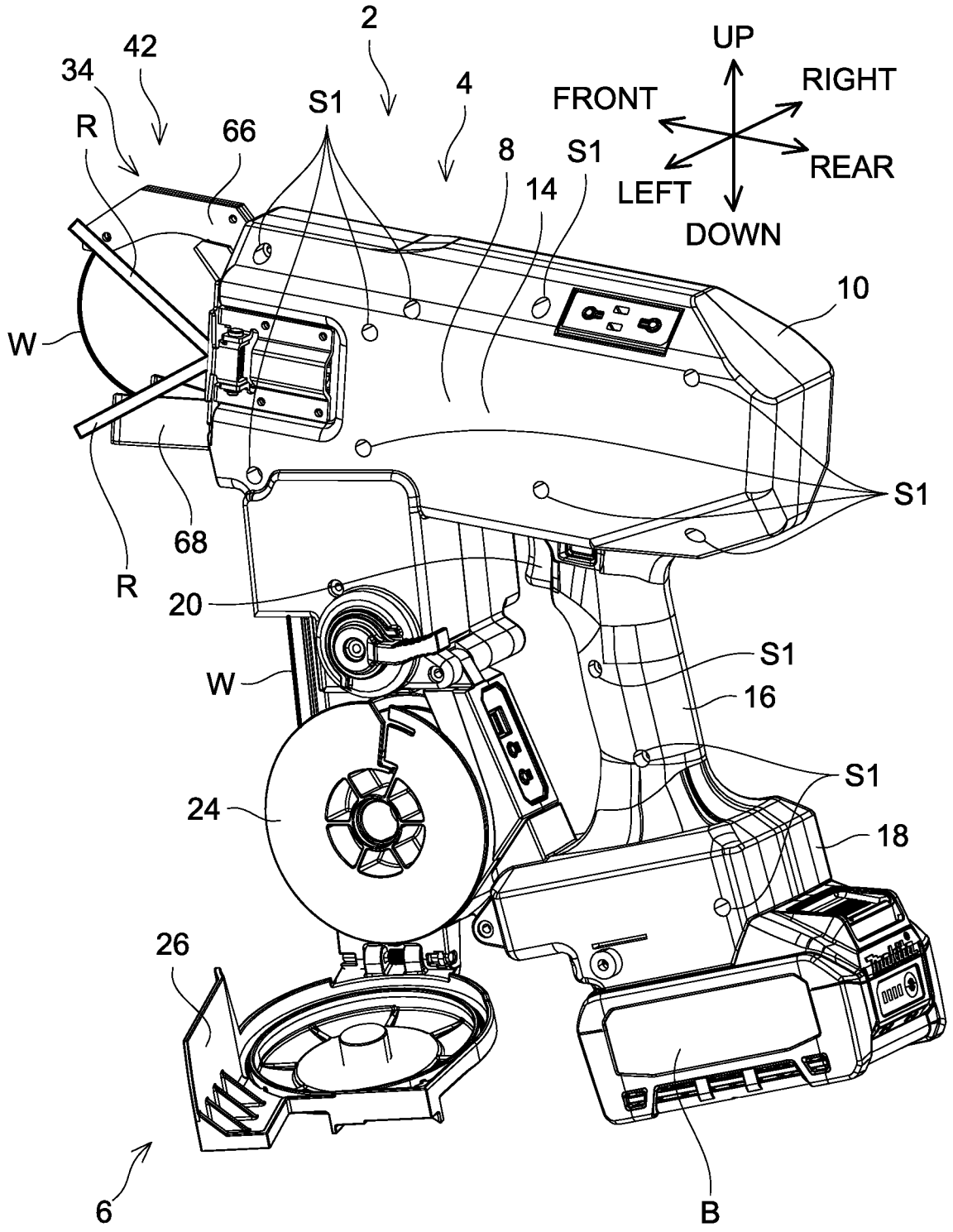
FIG. 2 is a perspective view of the rebar tying tool 2 of the first embodiment viewed from the rear left upper side.

The reel holder 6 is attached to a front lower portion of the body housing 14. As shown in FIG. 2, the reel holder 6 is configured to house a reel 24. The reel 24 has a wire W wound thereon. The reel 24 can be detachably attached to the reel holder 6 when a cover 26 of the reel holder 6 is open.

Figure 3:
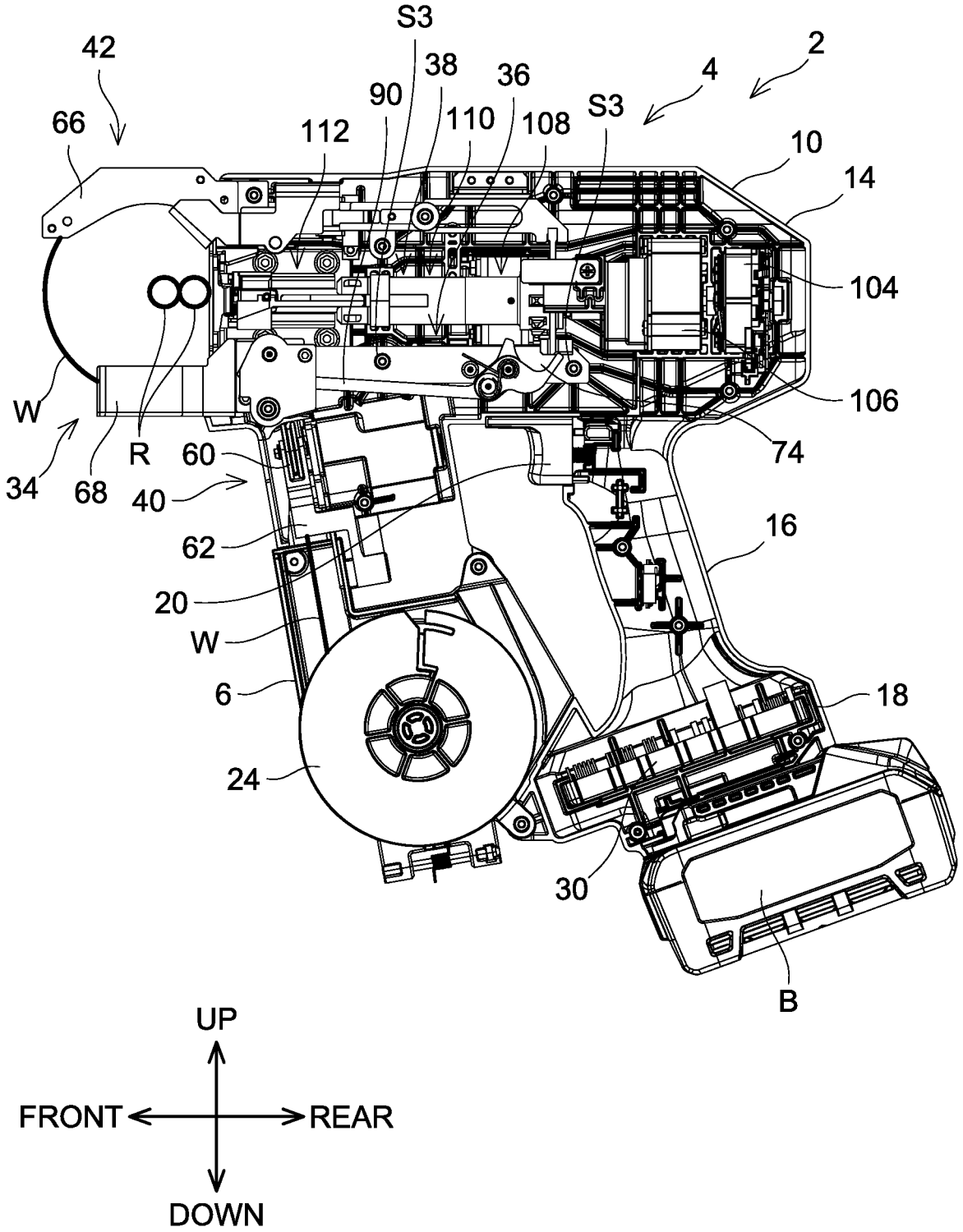
FIG. 3 is a side view showing an internal structure of the rebar tying tool 2 of the first embodiment.

As shown in FIG. 3, the rebar tying tool 2 comprises a control circuit board 30. The control circuit board 30 is housed in the battery receiving part 18. When the trigger 20 is pulled, the control circuit board 30 executes a tying operation for tying the rebars R with the wire W.

The rebar tying tool 2 comprises a feeder 34, a cutting unit 36, and a twisting unit 38. The feeder 34 comprises a feed unit 40 and a guide unit 42. The feed unit 40 is housed in a front portion of the body housing 14. The guide unit 42 is arranged on the front portion of the body housing 14. The cutting unit 36 and the twisting unit 38 are housed in the body housing 14.

Figure 4:
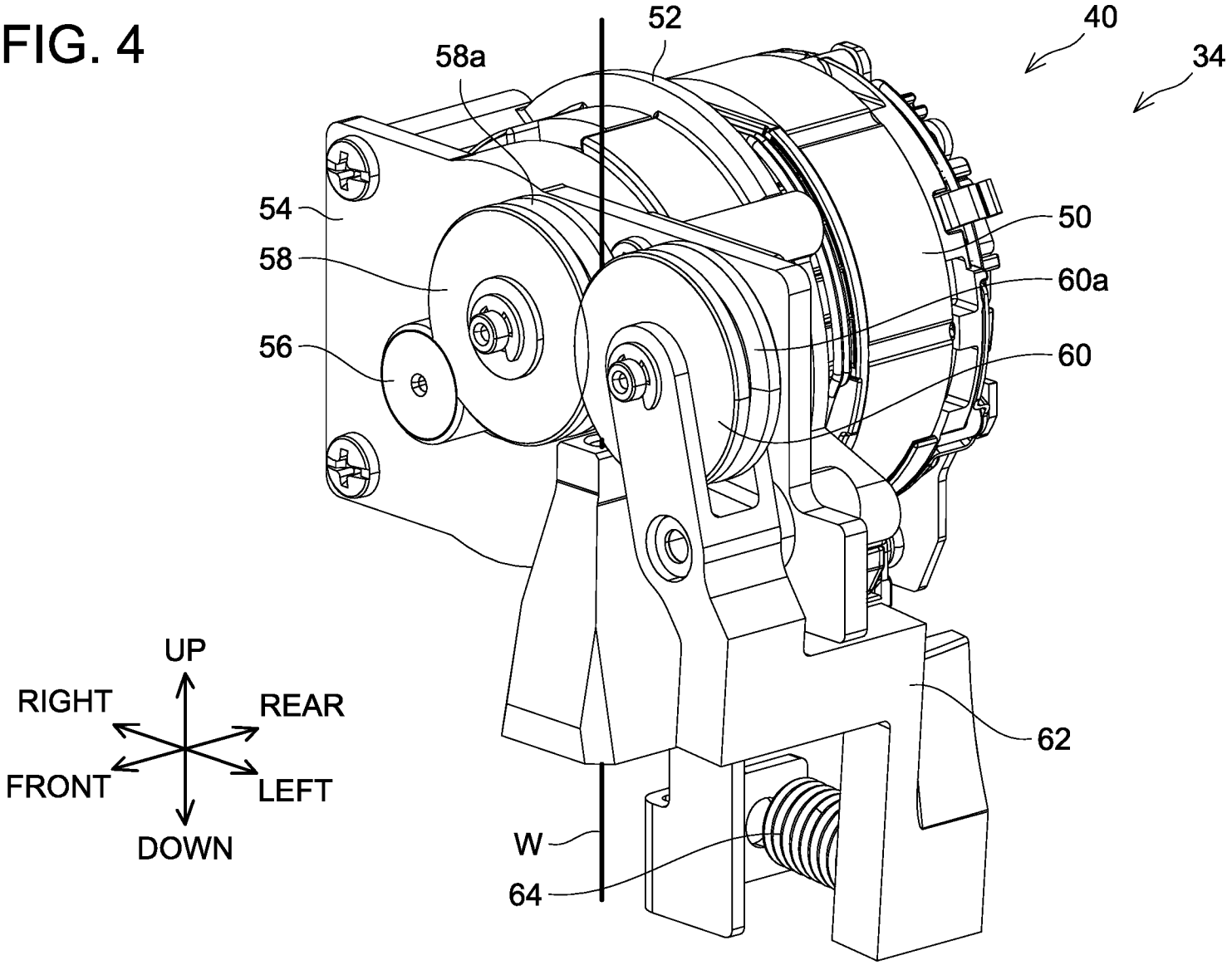
FIG. 4 is a perspective view of a feeder 34 of the first embodiment.

As shown in FIG. 4, the feed unit 40 comprises a feed motor 50, a speed reducer 52, a base member 54, a driving gear 56, a first feed gear 58, a second feed gear 60, a release lever 62, and a compression spring 64. The feed motor 50 is arranged on the right side of the right body 10 (see FIG. 1) and is covered by the motor cover 12 (see FIG. 1). The feed motor 50 is configured to operate on electric power supplied from the battery pack B (see FIG. 1). The feed motor 50 is for example a brushless motor. The feed motor 50 is configured to be controlled by the control circuit board 30 (see FIG. 3). The speed reducer 52 is configured to reduce rotation of the feed motor 50 and transmit the same to the driving gear 56.

The base member 54 is fixed to the body housing 14 (see FIG. 1). An outer circumferential surface of the first feed gear 58 meshes with an outer circumferential surface of the second feed gear 60. The first feed gear 58 is supported rotatably on the base member 54. The first feed gear 58 is configured to rotate by rotation of the driving gear 56. The first feed gear 58 comprises a groove 58*a* that defined in the outer circumferential surface and encircling a rotation axis. The first feed gear 58 contacts the wire W in the groove 58*a*. The second feed gear 60 is supported rotatably on the release lever 62. The second feed gear 60 comprises a groove 60*a* defined in the outer circumferential surface and encircling a rotation axis. The second feed gear 60 contacts the wire W in the groove 60*a*.

The release lever 62 is pivotably supported on the base member 54. The compression spring 64 is configured to bias the release lever 62 in a direction along which the second feed gear 60 approaches the first feed gear 58. Due to this, the second feed gear 60 is pressed against the first feed gear 58. As a result, the wire W is held between the groove 58*a* of the first feed gear 58 and the groove 60*a* of the second feed gear 60. When the feed motor 50 rotates with the wire W held between the groove 58*a* of the first feed gear 58 and the groove 60*a* of the second feed gear 60, the wire W is thereby moved.

Figure 5:
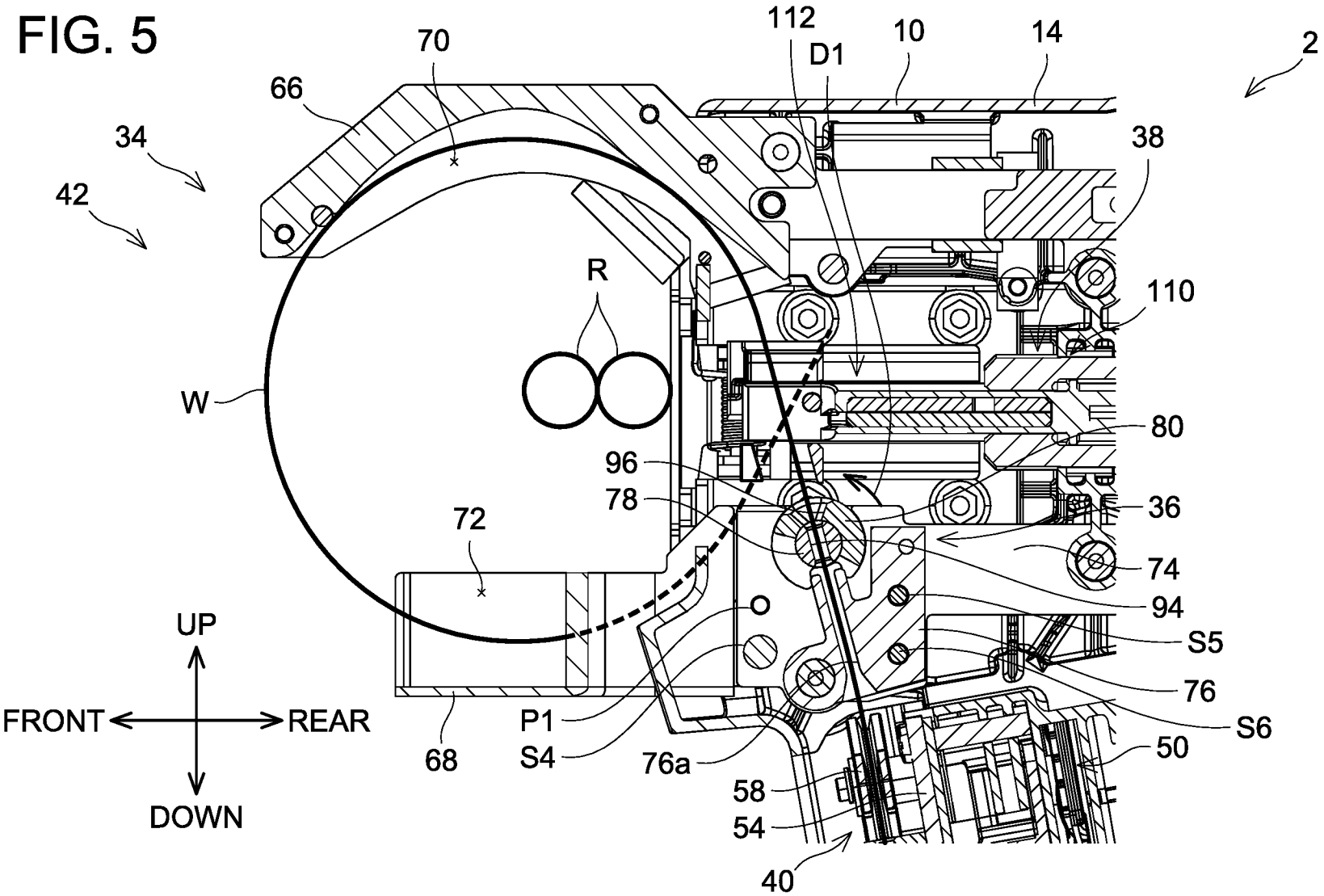
FIG. 5 is a cross-sectional view of a guide unit 42 of the rebar tying tool 2 of the first embodiment and its vicinity.

As shown in FIG. 5, the guide unit 42 comprises an upper curl guide 66 and a lower curl guide 68. The upper curl guide 66 and the lower curl guide 68 protrude forward beyond the front end of the body housing 14. The upper curl guide 66 opens downward. The upper curl guide 66 comprises an upper wire passage 70 that is curved upward. The lower curl guide 68 is arranged below the upper curl guide 66. The lower curl guide 68 opens upward. The lower curl guide 68 comprises a lower wire passage 72.

The wire W fed by the first feed gear 58 and the second feed gear 60 is fed into the upper wire passage 70. When the wire W moves forward inside the upper wire passage 70 from the rear side, the wire W is given a downward curl by the upper curl guide 66. The wire W that passed the upper wire passage 70 is fed into the lower wire passage 72. The wire W moves rearward inside the lower wire passage 72 from the front side, and is thereafter fed rearward and upward. Due to this, the wire W is wound around the rebars R.

As shown in FIG. 6, the cutting unit 36 comprises a base member 74, a first fixation member 75 (see FIG. 7), a guide member 76, a first cutter 78, a second cutter 80, a second fixation member 81 (see FIG. 7), a first lever member 82, a second lever member 84, a first shaft 86, a second shaft 88, a link member 90, a torsion spring 92, a connection pin 98, and a fixation pin 100.

The base member 74 is fixed to the body housing 14 (see FIG. 3) by a plurality of screws S3 (see FIG. 3). The front end of the base member 74 is fixed to the lower curl guide 68 by a screw S4 and a pin P1 (see FIG. 7).

As shown in FIGS. 7 and 8, the first fixation member 75 is arranged to the right of the base member 74 in the vicinity of the front end of the base member 74. The base member 74 and the first fixation member 75 are fixed by screws S4, S5 and the pin P1.

The guide member 76 is arranged to the left of the base member 74 in the vicinity of the front end of the base member 74. The base member 74 and the guide member 76 are fixed by screws S5, S6. The guide member 76 comprises a guide hole 76*a*. A width of the guide hole 76*a* gradually decreases toward the upper side from its lower side and becomes constant at a certain point. As shown in FIG. 5, the wire W that has been fed out by the first feed gear 58 and the second feed gear 60 (see FIG. 4) passes within the guide hole 76*a*.

The first cutter 78 and the second cutter 80 are constituted of a high-strength material. The first cutter 78 and the second cutter 80 may be constituted of a metal or ceramic material. The first cutter 78 and the second cutter 80 may for example be constituted of alloy tool steels (SKS, SKD, SKT, SKH), high-speed tool steels (SKH), chromium steels (SCR), chromium molybdenum steels (SCM), nickel chromium steels (SNC), or nickel chromium molybdenum steels (SNC). Further, the first cutter 78 and the second cutter 80 may for example be constituted of a material containing cemented carbides, such as tungsten carbide, as its main component, and this material may contain traces of materials other than tungsten carbide. Further, the first cutter 78 and the second cutter 80 may for example be constituted of high-speed tool steels (HSS).

As shown in FIGS. 7 and 8, the first cutter 78 has a substantially cylindrical shape. The first cutter 78 comprises a first fixing portion 78*a* at its right end. A cross section of the first fixing portion 78*a* is substantially rectangular. The first fixation member 75 has a first fixing hole 75*a* having a substantially rectangular shape, and the first fixing portion 78*a* is inserted in the first fixing hole 75*a*. Due to this, the first cutter 78 is fixed to the vicinity of the front end of the base member 74. The first cutter 78 is immobile relative to the body housing 14 (see FIG. 3). The first cutter 78 comprises a first cutting hole 94 through which the wire W can pass. The first cutting hole 94 is defined in the outer circumferential surface of the first cutter 78 and penetrates the first cutter 78. The first cutting hole 94 comprises a fixed cutting portion 94*a*. The second cutter 80 is supported by the first cutter 78 such that it can slide and rotate about the first cutter 78. The second cutter 80 is configured to rotate relative to the body housing 14 (see FIG. 3). The second cutter 80 comprises a second cutting hole 96 through which the wire W can pass. The second cutting hole 96 comprises a movable cutting portion 96*a*. Detailed structure of the second cutter 80 will be described later.

As shown in FIG. 5, the first cutter 78, the second cutter 80, and the guide hole 76*a* are arranged on a passage along which the wire W is fed from the feed unit 40 toward the upper curl guide 66. The wire W fed by the first feed gear 58 and the second feed gear 60 (see FIG. 4) is guided by the guide hole 76*a* and passes through the first cutting hole 94 and the second cutting hole 96. When the second cutter 80 rotates in a first direction D1 about the first cutter 78 such that it closes the first cutting hole 94 in the state where the wire W is within the first cutting hole 94 and the second cutting hole 96, the wire W is cut by the fixed cutting portion 94*a* and the movable cutting portion 96*a*.

As shown in FIGS. 7 and 8, the second fixation member 81 is arranged to the left of the guide member 76, the first cutter 78, and the second cutter 80. The second fixation member 81 is fixed to the guide member 76 by a screw S7. The second fixation member 81 comprises a second fixing hole 81*a* and a third fixing hole 81*b*. The guide member 76 comprises a fixed protrusion 76*b*, and the fixed protrusion 76*b* is inserted in the second fixing hole 81*a*. The first cutter 78 comprises a second fixing portion 78*b* at its left end, and the second fixing portion 78*b* is inserted in the third fixing hole 81*b*. The first cutter 78 is interposed between the first fixation member 75 and the second fixation member 81 and is fixed by the first fixation member 75 and the second fixation member 81.

As shown in FIG. 6, the first lever member 82 and the second lever member 84 are fixed by the first shaft 86 and the second shaft 88. The first shaft 86 and the second shaft 88 are inserted through the first lever member 82 and the second lever member 84. The first shaft 86 is fixed to the base member 74, and the first lever member 82 and the second lever member 84 rotate about the first shaft 86. The second shaft 88 is inserted through the lower end of the first lever member 82 and the lower end of the second lever member 84. When the first lever member 82 and the second lever member 84 rotate about the first shaft 86, the second shaft 88 moves together with the first lever member 82 and the second lever member 84. The first lever member 82 comprises a first protrusion 82*a* configured to be operated by the twisting unit 38. The second lever member 84 comprises a second protrusion 84*a* configured to be operated by the twisting unit 38.

The rear end of the link member 90 is fixed to the second shaft 88. The link member 90 is configured to rotate about the second shaft 88. The front end of the link member 90 is fixed to the second cutter 80 via the connection pin 98.

The torsion spring 92 is attached to the first shaft 86. One end of the torsion spring 92 is in contact with the second shaft 88. The fixation pin 100 is fixed to the base member 74, and the other end of the torsion spring 92 is in contact with the fixation pin 100. The torsion spring 92 biases the second shaft 88 frontward.

As shown in FIG. 6, before the cutting unit 36 cuts the wire W, the second shaft 88 is located frontward of the first shaft 86. When the second protrusion 84*a* is operated frontward, the second shaft 88 moves rearward as shown in FIG. 9, and the link member 90 moves rearward accompanying the movement of the second shaft 88. Due to this, the second cutter 80 rotates in the first direction D1 (see FIG. 6) and the wire W is thereby cut.

As shown in FIG. 10, the twisting unit 38 comprises a twisting motor 104, a speed reducer 106, and a holder 108. The twisting motor 104 and the speed reducer 106 are supported on the body housing 14 (see FIG. 3). The twisting motor 104 is configured to operate on the electric power supplied from the battery pack B (see FIG. 3). The twisting motor 104 is for example a brushless motor. The twisting motor 104 is configured to be controlled by the control circuit board 30 (see FIG. 3). The speed reducer 106 is configured to reduce rotation of the twisting motor 104 and transmit the same to the holder 108.

The holder 108 comprises a sleeve unit 110 and a holder unit 112. The sleeve unit 110 is configured to move forward and rearward and rotate accompanying the rotation of the twisting motor 104. The sleeve unit 110 comprises a push plate 114 arranged in the vicinity of its rear end. The push plate 114 is configured to move frontward and rearward accompanying the rotation of the twisting motor 104 but does not rotate. As shown in FIGS. 6 and 9, the push plate 114 is configured to operate the second protrusion 84*a* to move forward when the sleeve unit 110 moves forward, and operate the first protrusion 82*a* to move rearward when the sleeve unit 110 moves rearward.

As shown in FIG. 10, the holder unit 112 is inserted into the sleeve unit 110 from the front side of the sleeve unit 110. The holder unit 112 comprises a shaft member 116, a left holder member 118, and a right holder member 120. When the rebar tying tool 2 is in the initial state that is before tying the rebars R, a left wire passage 122 is defined between the shaft member 116 and the left holder member 118 and a right wire passage 124 is defined between the shaft member 116 and the right holder member 120. The wire W can be fed into the left wire passage 122 and the right wire passage 124. When the sleeve unit 110 moves forward, the right holder member 120 moves leftward relative to the shaft member 116. Due to this, the right wire passage 124 is narrowed, and the wire W is held between the shaft member 116 and the right holder member 120. When the sleeve unit 110 further moves forward, the left holder member 118 moves rightward relative to the shaft member 116. Due to this, the left wire passage 122 is narrowed, and the wire W is held between the shaft member 116 and the left holder member 118. When the sleeve unit 110 rotates after the wire W is cut, the wire W on the rebars R is thereby twisted.

As shown in FIGS. 11 and 12, the second cutter 80 comprises a base 130 and a side portion 132. The base 130 has a flat plate shape. The base 130 comprises a first wide surface 130*a* and a second wide surface 130*b* located opposite to the first wide surface 130*a*. The first wide surface 130*a* faces the left surface of the base member 74 (see FIG. 7). The base 130 comprises a first opening 134 into which the first cutter 78 (see FIG. 7) is inserted and a second opening 136 into which the connection pin 98 (see FIG. 7) is inserted. The first opening 134 and the second opening 136 penetrate the base 130 in a thickness direction. The second cutter rotates about the first cutter 78 with the first cutter 78 inserted in the first opening 134.

The side portion 132 is arranged at a periphery of the base 130. In FIGS. 11 and 12, a boundary between the base 130 and the side portion 132 is shown by a broken line. When the first cutter 78 is inserted in the first opening 134, an inner surface 132*a* of the side portion 132 faces the first cutter 78. As shown in FIG. 7, the base member 74 comprises a groove 137, and a part of the side portion 132 is arranged in the groove 137. When the second cutter 80 rotates about the first cutter 78 in the first direction D1 (see FIG. 6), the side portion 132 moves within the groove 137 such that an end surface of the side portion 132 comes to a position very close to a step portion 137*a* arranged at one end of the groove 137. As shown in FIGS. 11 and 12, the side portion 132 comprises a first supporting part 138, a cutting part 140, and a second supporting part 142. The first supporting part 138, the cutting part 140, and the second supporting part 142 are integrally formed.

The first supporting part 138 comprises a supporting peripheral portion 144 and a supporting protrusion 146. The supporting peripheral portion 144 extends outward (the rightward) beyond the first wide surface 130*a* from the periphery of the base 130 and also outward (leftward) beyond the second wide surface 130*b* from the periphery of the base 130. The supporting peripheral portion 144 is connected to the periphery of the base 130. The supporting peripheral portion 144 comprises a curved portion 148 extending and curving along a periphery of the first opening 134 and a straight portion 150 extending straight. The curved portion 148 is connected to the straight portion 150 via a connecting portion 152. The supporting protrusion 146 is connected to the supporting peripheral portion 144 at the vicinity of the connecting portion 152. The supporting protrusion 146 extends outward (rightward) from the right end of the supporting peripheral portion 144.

The cutting part 140 is connected to the right end of the supporting peripheral portion 144. In FIGS. 11 to 13, a boundary between the cutting part 140 and the supporting peripheral portion 144 is shown by a one-dot chain line. The cutting part 140 is connected to the supporting peripheral portion 144 at a first portion 154. The cutting part 140 is supported by the supporting peripheral portion 144 at the first portion 154, which is disposed at one end (left end) of the cutting part 140. The cutting part 140 extends by curving along the periphery of the first opening 134. The cutting part 140 is arranged apart from the supporting protrusion 146 in a direction along the periphery of the first opening 134. The cutting part 140 faces the supporting protrusion 146. The cutting part 140 comprises a cutting edge 156 arranged facing the supporting protrusion 146. The cutting edge 156 constitutes the movable cutting portion 96*a*. The cutting edge 156 is a sharpened edge with an acute angle. The cutting edge 156 is configured to contact and cut the wire W.

The second supporting part 142 is connected to both the right end of the cutting part 140 and the right end of the supporting protrusion 146. In FIGS. 11 to 14, the boundary between the second supporting part 142 and the cutting part 140 and the boundary between the second supporting part 142 and the supporting protrusion 146 are shown by a two-dot chain line. The cutting part 140 is connected to the second supporting part 142 at a second portion 158. The cutting part 140 is supported by the second supporting part 142 at the second portion 158. The second portion 158 is disposed at the other end (right end) within the cutting part 140 that is opposite to the first portion 154. The second supporting part 142 extends by curving along the periphery of the first opening 134. The second supporting part 142 is arranged apart from the supporting peripheral portion 144 in the left-right direction. The second supporting part 142 faces the supporting peripheral portion 144.

The second cutting hole 96 is defined in the side portion 132. The second cutting hole 96 penetrates the side portion 132 from its inner surface 132*a* to its outer surface 132*b*. The second cutting hole 96 is defined by the end surface of the cutting part 140, the left surface of the second supporting part 142, the right surface of the supporting peripheral portion 144, and the end surface of the supporting protrusion 146. The end surface of the cutting part 140, the left surface of the second supporting part 142, the right surface of the supporting peripheral portion 144, and the end surface of the supporting protrusion 146 have substantially planar shapes. The second cutting hole 96 is configured by being surrounded by the cutting part 140, the second supporting part 142, the supporting peripheral portion 144, and the supporting protrusion 146. The cutting edge 156 defines a part of the second cutting hole 96. A cross section of the second cutting hole 96 increases from the inner surface 132*a* toward the outer surface 132*b* of the side portion 132. The outer surface 132*b* is a surface opposite to the inner surface 132*a*.

As shown in FIG. 12, a cross section of the second cutting hole 96 has a substantially rectangular shape. Short sides of the cross section of the second cutting hole 96 extend along the left-right direction. Long sides of the cross section of the second cutting hole 96 extend along a direction perpendicular to the left-right direction. In a variant, the cross section of the second cutting hole 96 may be substantially elliptic or circular. Here, the cross section of the second cutting hole 96 refers to a cross section of the second cutting hole 96 extending along a plane perpendicular to the center axis of the second cutting hole 96, and the center axis of the second cutting hole 96 extends in a direction from the inner surface 132*a* toward the outer surface 132*b* of the side portion 132 and is substantially perpendicular to the inner surface 132*a* and the outer surface 132*b*. The cross section of the second cutting hole 96 comprises two first edges 162, 164, two second edges 166, 168, and four third edges 170, 172, 174, 176. The first edges 162, 164 correspond to the short sides of the cross section of the second cutting hole 96. The first edges 162, 164 extend straight along the left-right direction. The first edge 162 is arranged in the cutting edge 156, and the first edges 162, 164 are arranged in the supporting protrusion 146. The first edges 162, 164 are arranged to face each other and are substantially parallel to each other. A length of the first edges 162, 164 is substantially constant between the inner surface 132*a* and the outer surface 132*b* of the side portion 132.

The second edges 166, 168 correspond to the long sides of the cross section of the second cutting hole 96. The second edges 166, 168 extend straight. The second edge 166 is arranged in the supporting peripheral portion 144 and the second edge 168 is arranged in the second supporting part 142. The second edges 166, 168 are arranged to face each other and are substantially parallel to each other. The second edges 166, 168 are substantially perpendicular to the first edges 162, 164. A length of the second edges 166, 168 becomes longer from the inner surface 132*a* toward the outer surface 132*b* of the side portion 132.

The third edges 170, 172, 174, 176 correspond to corners of the cross section of the second cutting hole 96. The third edge 170 connects the first edge 162 and the second edge 166, the third edge 172 connects the first edge 162 and the second edge 168, the third edge 174 connects the first edge 164 and the second edge 166, and the third edge 176 connects the first edge 164 and the second edge 168. The third edges 170, 172, 174, 176 are curved. Curvature radii of the third edges 170, 172, 174, 176 are identical to each other. In a variant, the curvature radii of the third edges 170, 172, 174, 176 may be different from each other. A length of the third edges 170, 172, 174, 176 is substantially constant between the inner surface 132*a* and the outer surface 132*b* of the side portion 132.

An operation for cutting the wire W will be described. When the second cutter 80 rotates about the first cutter 78 in the first direction D1 (see FIG. 5), the first cutting hole 94 is gradually closed by the second cutter 80 as shown in FIG. 14. The wire W is cut by being held between the fixed cutting portion 94*a* and the movable cutting portion 96*a*. At this occasion, the wire W is pressed against the fixed cutting portion 94*a* and the fixed cutting portion 94*a* receives a reaction force F0 from the wire W. In FIG. 14, only the cross section of the wire W is shown. Further, as shown in FIG. 13, the wire W is pressed against the cutting edge 156 (first edge 162) which is the movable cutting portion 96*a* of the second cutter 80 and the cutting edge 156 receives a reaction force F1 from the wire W. In general, this reaction force F1 (F0) becomes greater when the diameter of the wire W is larger and/or hardness of the wire W is higher. The reaction force F1 acts on the cutting edge 156 in a direction directed from the supporting protrusion 146 (first edge 164) toward the cutting edge 156. Further, the supporting peripheral portion 144 and the second supporting part 142 also receive the reaction force F1 via the cutting part 140. The reaction force F1 is dispersed and acts onto the supporting peripheral portion 144 and the second supporting part 142. Due to this, even when the cutting edge 156 receives the reaction force F1, the cutting part 140 tends not to deform in a direction along which the cutting edge 156 separates away from the supporting protrusion 146. Further, even when the cutting edge 156 receives the reaction force F1, the stress is dispersed to the connecting portion (first portion 154) between the cutting part 140 and the supporting peripheral portion 144 and the vicinity thereof, and to the connecting portion (second portion 158) between the cutting part 140 and the second supporting part 142 and the vicinity thereof. Due to this, for example even when a wire W having a large diameter of 1.6 mm or more and/or a wire W having high hardness is used, the second cutter 80 can be suppressed from being damaged with, for example, the first portion 154 and/or the second portion 158 as a starting point of breakage. Further, since the third edges 170, 172 are curved, even when the cutting edge 156 receives the reaction force F1, stress is dispersed substantially uniformly over the entireties of the third edges 170, 172. Due to this, the second cutter 80 can further be suppressed from being damaged.

Effects

The rebar tying tool 2 according to the present embodiment is configured to tie the rebars R with the wire W. The rebar tying tool 2 comprises the first cutter 78 and the second cutter 80 configured to cut the wire W by moving relative to the first cutter 78. The second cutter 80 comprises the cutting part 140 that contacts and cuts the wire W, the first supporting part 138 (an example of "first connecting part") connected to the first portion 154 of the cutting part 140, and the second supporting part 142 (an example of "second connecting part") connected to the second portion 158 of the cutting part 140, the second portion 158 being different from the first portion 154.

According to the above configuration, since the cutting part 140 is connected to the first supporting part 138 and the second supporting part 142. Thus, when the cutting part 140 receives the reaction force F1 from the wire W upon cutting the wire W, stress generated therefrom is dispersed to the cutting part 140, the first supporting part 138 and the vicinity thereof, and to the cutting part 140, the second supporting part 142 and the vicinity thereof. Due to this, the second cutter 80 can be suppressed from being damaged.

Further, the first portion 154 of the cutting part 140 is arranged at one end of the cutting part 140. The second portion 158 of the cutting part 140 is disposed at the other end of the cutting part 140, the other end being opposite to the one end.

As compared to the configuration in which the first portion 154 of the cutting part 140 is not disposed at the one end of the cutting part 140 and the second portion 158 of the cutting part 140 is not disposed at the other end of the cutting part 140, the entire second cutter 80 can be made compact.

Further, the second cutter 80 further comprises the second cutting hole 96 (an example of "cutting hole") defined by the cutting part 140, the first supporting part 138, and the second supporting part 142 and constituting a through hole. The cutting part 140 is configured to cut the wire W inserted in the second cutting hole 96.

According to the above configuration, when the cutting part 140 cuts the wire W, stress can be suppressed from concentrating at the first supporting part 138 or at the second supporting part 142. Due to this, the second cutter 80 can further be suppressed from being damaged.

Further, the cross section of the second cutting hole 96 comprises the first edge 162 arranged in the cutting part 140 and configured to contact and cut the wire W, the second edge 166 arranged in the first supporting part 138, and the third edge 170 connecting the first edge 162 and the second edge 166. The third edge 170 is curved.

With the configuration in which the cross section of the second cutting hole 96 does not have the third edge 170, the stress concentrates at the connecting portion between the first edge 162 and the second edge 166 when the cutting part 140 cuts the wire W. According to the above configuration, when the cutting part 140 cuts the wire W, the stress is dispersed at the curved third edge 170. Due to this, the second cutter 80 can further be suppressed from being damaged.

Further, the second edge 166 extends straight.

With the configuration in which the second edge 166 is bent, the stress concentrates at its bent portion and the vicinity when the cutting part 140 cuts the wire W. According to the above configuration, the stress can be suppressed from concentrating at a certain portion of the second edge 166 and its vicinity when the cutting part 140 cuts the wire W. Due to this, the second cutter 80 can further be suppressed from being damaged.

Further, the second edge 166 is substantially perpendicular to the first edge 162.

According to the above configuration, the wire W can be suppressed from moving on the first edge 162 when the cutting part 140 cuts the wire W.

Further, the second supporting part 142 is connected to the first supporting part 138.

According to the above configuration, even when the cutting part 140 receives the reaction force F1 from the wire W when it cuts the wire W, the second cutter 80 can further be suppressed from being damaged.

Further, the cutting part 140, the first supporting part 138, and the second supporting part 142 are integrally formed.

According to the above configuration, the configurations of the cutting part 140, the first supporting part 138, and the second supporting part 142 can be suppressed from becoming complicated.

Further, the second cutter 80 is configured to rotate relative to the first cutter 78.

According to the above configuration, as compared to the case in which the second cutter 80 slides linearly relative to the first cutter 78, a space in which the first and second cutters 78, 80 are arranged can be made small.

The rebar tying tool 2 disclosed herein is configured to tie the rebars R with the wire W. The rebar tying tool 2 comprises the body housing 14 (an example of "housing") and the second cutter 80 (an example of "cutter") configured to cut the wire W by being rotated relative to the body housing 14. The second cutter 80 comprises the cutting part 140 configured to contact and cut the wire W, the first supporting part 138 configured to support one end of the cutting part 140 such that the one end of the cutting part 140 is rotatable relative to the body housing 14, and the second supporting part 142 configured to support the other end of the cutting part 140 such that the other end of the cutting part 140 is rotatable relative to the body housing 14. The first supporting part 138 and the second supporting part 142 receive the reaction force F1 which the cutting part 140 receives from the wire W when the cutting part 140 cuts the wire W.

According to the above configuration, since the first supporting part 138 and the second supporting part 142 receive the reaction force F1 which the cutting part 140 receives from the wire W when the cutting part 140 cuts the wire W, the stress is dispersed to the cutting part 140, the first supporting part 138 and the vicinity thereof, and to the cutting part 140, the second supporting part 142 and the vicinity thereof. Due to this, the second cutter 80 can be suppressed from being damaged.

Second Embodiment

In a second embodiment, only the points that differ from the first embodiment will be described. As shown in FIG. 15, in the second embodiment, the second supporting part 142 of the second cutter 80 is configured as a separate member from the first supporting part 138 and the cutting part 140. The second supporting part 142 is detachable from the first supporting part 138 and the cutting part 140.

The first supporting part 138 comprises a first protrusion 200. The first protrusion 200 protrudes outward (rightward) from the right end of the supporting protrusion 146. The cutting part 140 comprises a second protrusion 202. The second protrusion 202 protrudes outward (rightward) from the right end of the cutting part 140.

The second supporting part 142 comprises a first receiving part 204 and a second receiving part 206. The first receiving part 204 and the second receiving part 206 are recessed inward (rightward) from the left surface of the second supporting part 142. When the second supporting part 142 is connected to the first supporting part 138 and the cutting part 140, the first receiving part 204 is fitted with the first protrusion 200 by receiving the same, and the second receiving part 206 is fitted with the second protrusion 202 by receiving the same.

(Corresponding Relationships)

The first cutter 78, the second cutter 80, the cutting part 140, the first supporting part 138, and the second supporting part 142 are respectively an example of "first cutter", "second cutter", "cutting part", "first connecting part", and "second connecting part". The first portion 154 and the second portion 158 are respectively an example of "first portion" and "second portion". The second cutting hole 96, the first edge 162, the second edge 166, and the third edge 170 are respectively an example of "cutting hole", "first edge", "second edge", and "third edge".

Third Embodiment

In a third embodiment, only the points that differ from the first embodiment will be described. As shown in FIG. 16, in the third embodiment, the shape of the second supporting part 142 of the second cutter 80 differs from the shape of the second supporting part 142 of the first embodiment, and the first supporting part 138 does not comprise the supporting protrusion 146.

The second supporting part 142 is connected to the right end of the cutting part 140. The second supporting part 142 has a ring shape. The second supporting part 142 comprises an insertion opening 300 that penetrates the second supporting part 142 in a thickness direction (left-right direction). The insertion opening 300 is arranged facing the first opening 134 of the base 130. The second cutter 80 is supported by the first cutter 78 by the first cutter 78 (see FIG. 7) being inserted in the first opening 134 and the insertion opening 300.

(Corresponding Relationship)

The first cutter 78, the second cutter 80, the cutting part 140, the first supporting part 138, and the second supporting part 142 are respectively an example of "first cutter", "second cutter", "cutting part", "first connecting part", and "second connecting part". The first portion 154 and the second portion 158 are respectively an example of "first portion" and "second portion". The second cutting hole 96, the first edge 162, the second edge 166, and the third edge 170 are respectively an example of "cutting hole", "first edge", "second edge", and "third edge".

Fourth Embodiment

In a fourth embodiment, only the points that differ from the first embodiment will be described. As shown in FIG. 17, in the fourth embodiment, the side portion 132 of the second cutter 80 does not comprise the second supporting part 142 of the first embodiment.

As shown in FIG. 18, the cutting part 140 is configured as a separate member from the first supporting part 138. The cutting part 140 comprises a first receiving part 400 and a second receiving part 402. The first receiving part 400 and the second receiving part 402 are recessed inward (rightward) from the left surface of the cutting part 140. The first receiving part 400 and the second receiving part 402 are arranged adjacently along a periphery of the first opening 134.

As shown in FIG. 19, the first supporting part 138 comprises a third receiving part 404 and a fourth receiving part 406. The third receiving part 404 and the fourth receiving part 406 are recessed inward (leftward) from the right end of the supporting peripheral portion 144. The third receiving part 404 is arranged facing the first receiving part 400, and the fourth receiving part 406 is arranged facing the second receiving part 402. The third receiving part 404 and the fourth receiving part 406 are arranged adjacently along the periphery of the first opening 134.

The side portion 132 further comprises a first coupling part 408 and a second coupling part 410. The first coupling part 408 and the second coupling part 410 are separate members from both the first supporting part 138 and the cutting part 140. The first coupling part 408 and the second coupling part 410 have a substantially columnar shape. The first coupling part 408 and the second coupling part 410 are for example coupling pins. The first coupling part 408 and the second coupling part 410 are constituted of a high-strength material. The first coupling part 408 and the second coupling part 410 may be constituted of a metal or ceramic material. The first coupling part 408 and the second coupling part 410 may for example be constituted of alloy tool steels (SKS, SKD, SKT, SKH), high-speed tool steels (SKH), chromium steels (SCR), chromium molybdenum steels (SCM), nickel chromium steels (SNC), or nickel chromium molybdenum steels (SNC). Further, the first coupling part 408 and the second coupling part 410 may for example be constituted of a material containing cemented carbides, such as tungsten carbide, as its main component, and this material may contain traces of materials other than tungsten carbide. Further, the first coupling part 408 and the second coupling part 410 may for example be constituted of high-speed tool steels (HSS). Strength of the first coupling part 408 and strength of the second coupling part 410 are higher than strength of the first supporting part 138 and strength of the cutting part 140.

As shown in FIGS. 18 and 19, the first coupling part 408 is fitted with the first receiving part 400 and the third receiving part 404 by being received in the first receiving part 400 and the third receiving part 404. Further, the second coupling part 410 is fitted with the second receiving part 402 and the fourth receiving part 406 by being received in the second receiving part 402 and the fourth receiving part 406. Due to this, the cutting part 140 is connected (fixed) to the first supporting part 138 via the first coupling part 408 and the second coupling part 410.

As shown in FIG. 20, the second cutting hole 96 is defined by the end surface of the cutting part 140, the right surface of the supporting peripheral portion 144, and the end surface of the supporting protrusion 146. The right end of the second cutting hole 96 is open (not closed). The cross section of the second cutting hole 96 incudes the first edges 162, 164 and the second edge 166. The first edge 162 is arranged in the cutting edge 156 of the cutting part 140. The first edge 164 is arranged in the supporting protrusion 146. The second edge 166 is arranged in the supporting peripheral portion 144. The second edge 166 is connected to each of the first edges 162, 164. The second edge 166 is substantially perpendicular to the first edges 162, 164.

When the second cutter 80 rotates about the first cutter 78 (see FIG. 5) in the first direction D1 (see FIG. 5) and the cutting edge 156 of the cutting part 140 cuts the wire W, the wire W is pressed against the cutting edge 156 (first edge 162). As shown in FIG. 20, the cutting edge 156 receives a reaction force F2 from the wire W. The reaction force F2 acts on the cutting edge 156 in a direction extending from the supporting protrusion 146 (first edge 164) toward the cutting edge 156. Further, the first coupling part 408, the second coupling part 410 (see FIGS. 16 and 17), and the supporting peripheral portion 144 receive the reaction force F2 via the cutting part 140. At this occasion, stress is dispersed substantially uniformly to a boundary between the first coupling part 408 and the cutting part 140, a boundary between the first coupling part 408 and the supporting peripheral portion 144, a boundary between the second coupling part 410 and the cutting part 140, and a boundary between the second coupling part 410 and the supporting peripheral portion 144. Due to this, even when the cutting edge 156 receives the reaction force F2, the second cutter 80, such as the cutting part 140, can be suppressed from being damaged.

Effects

The rebar tying tool 2 according to the present embodiment is configured to tie the rebars R with the wire W. The rebar tying tool 2 comprises the first cutter 78 and the second cutter 80 configured to cut the wire W by moving relative to the first cutter 78. The second cutter 80 comprises the cutting part 140 configured to contact and cut the wire W, the first supporting part 138 (an example of "connecting part") connected to the cutting part 140, and the first coupling part 408 and the second coupling part 410 (an example of "at least one coupling part"). One of the cutting part 140 and the first supporting part 138 comprises the first receiving part 400 and the second receiving part 402 (the third receiving part 404 and the fourth receiving part 406; and example of "at least one receiving part") recessed toward inside of the one of the cutting part 140 and the first supporting part 138 and receiving the first coupling part 408 and the second coupling part 410. The first supporting part 138 is connected to the cutting part 140 by the first receiving part 400 (or the third receiving part 404) receiving the first coupling part 408 and the second receiving part 402 (or the fourth receiving part 406) receiving the second coupling part 410.

According to the above configuration, when the cutting part 140 receive the reaction force F2 from the wire W upon cutting the same, the stress is dispersed to a boundary region between the first coupling part 408 and the first receiving part 400 (or the third receiving part 404) and a boundary region between the second coupling part 410 and the second receiving part 402 (or the fourth receiving part 406). Due to this, the second cutter 80 can be suppressed from being damaged.

Further, the cutting part 140 comprises the first edge 162 (an example of "cutting surface") configured to contact and cut the wire W. The first supporting part 138 comprises the second edge 166 (an example of "supporting surface") connected to the first edge 162 and substantially perpendicular to the first edge 162.

According to the above configuration, the wire W can be suppressed from moving on the first edge 162 when the cutting part 140 cuts the wire W.

Fifth Embodiment

In a fifth embodiment, only the points that differ from the fourth embodiment will be described. As shown in FIG. 21, in the fifth embodiment, the first coupling part 408 and the second coupling part 410 are integrally formed with the first supporting part 138. The first supporting part 138 does not comprise the third receiving part 404 or the fourth receiving part 406 of the fourth embodiment.

The first coupling part 408 and the second coupling part 410 protrude outward (rightward) from the right end of the supporting peripheral portion 144. The first coupling part 408 is fitted in the first receiving part 400 by being received in the first receiving part 400. The second coupling part 410 is fitted in the second receiving part 402 by being received in the second receiving part 402. Due to this, the cutting part 140 is connected (fixed) to the first supporting part 138.

In a variant, the first coupling part 408 and the second coupling part 410 may be integrally formed with the cutting part 140 and protrude outward (leftward) from the left surface of the cutting part 140. In this case, the cutting part 140 does not comprise the first receiving part 400 or the second receiving part 402.

Effects

In the present embodiment, the other of the cutting part 140 and the first supporting part 138 is integrally formed with the first coupling part 408 and the second coupling part 410. The first coupling part 408 and the second coupling part 410 protrude outward from the other of the cutting part 140 and the first supporting part 138.

According to the above configuration, the configuration of the second cutter 80 can be suppressed from becoming complicated.

Sixth Embodiment

In a sixth embodiment, only the points that differ from the fourth embodiment will be described. As shown in FIG. 22, in the sixth embodiment, the shape of the second cutting hole 96 differs from the shape of the second cutting hole 96 in the fourth embodiment. Further, the first supporting part 138, the cutting part 140, the first coupling part 408 (see FIG. 18), and the second coupling part 410 (see FIG. 18) are integrally formed. The second cutter 80 is configured of a single component.

The first edge 162 of the second cutting hole 96 is tilted relative to the first edge 164. Further, the first edge 162 is tilted relative to the second edge 166 at an angle A1, which is different from the substantial 90 degrees. The angle A1 formed by the first edge 162 and the second edge 166 is an obtuse angle. The angle A1 is greater than 90 degrees and is equal to or less than 135 degrees. In the present embodiment, the angle A1 is 105 degrees.

When the second cutter 80 rotates about the first cutter 78 (see FIG. 5) in the first direction D1 (see FIG. 5) and the cutting edge 156 of the cutting part 140 cuts the wire W, the wire W is pressed against the cutting edge 156 (first edge 162). As shown in FIG. 22, the cutting edge 156 receives a reaction force F3 from the wire W. The reaction force F3 acts on the cutting edge 156 in the direction extending from the supporting protrusion 146 (first edge 164) toward the cutting edge 156. Since the angle A1 is an obtuse angle, stress is suppressed from concentrating at a coupling portion between the cutting part 140 and the supporting peripheral portion 144 and the vicinity thereof (at the connecting portion of the first edge 162 and the second edge 166 and the vicinity thereof). Even when the cutting edge 156 receives the reaction force F3, the cutting part 140 tends not to deform in a direction along which the cutting edge 156 separates away from the supporting protrusion 146. Due to this, the second cutter 80 can be suppressed from being damaged with the coupling portion (first portion 154) between the cutting part 140 and the supporting peripheral portion 144 as a starting point of breakage.

In a variant, the first supporting part 138, the cutting part 140, the first coupling part 408 (see FIG. 18), and the second coupling part 410 (see FIG. 18) may be separate members.

Seventh Embodiment

In a seventh embodiment, only the points that differ from the fourth embodiment will be described. As shown in FIG. 23, in the seventh embodiment, the cutting unit 36 further comprises a deformation-restricting wall 500. Further, the first supporting part 138, the cutting part 140, the first coupling part 408 (see FIG. 18), and the second coupling part 410 (see FIG. 18) are integrally formed. The second cutter 80 is configured of a single component. In FIGS. 23 and 24, the first cutter 78 is omitted to facilitate understanding of shapes of the second cutter 80 and the deformation-restricting wall 500.

The deformation-restricting wall 500 is integrally formed with the guide member 76. The deformation-restricting wall 500 protrudes from the guide member 76 in a direction separating away from the left surface of the base member 74 (leftward). The deformation-restricting wall 500 extends along the side portion 132 of the second cutter 80. The deformation-restricting wall 500 curves along the outer surface 132*b* of the side portion 132. The deformation-restricting wall 500 faces the side portion 132.

As shown in FIG. 24, when the second cutter 80 rotates about the first cutter 78 (see FIG. 5) in the first direction D1 and the cutting edge 156 of the cutting part 140 cuts the wire W, the wire W is pressed against the cutting edge 156 (first edge 162). As shown in FIG. 24, the cutting edge 156 receives a reaction force F4 from the wire W. The reaction force F4 acts on the cutting edge 156 in the direction extending from the supporting protrusion 146 (first edge 164) toward the cutting edge 156. By the cutting edge 156 receiving the reaction force F4, the cutting part 140 contacts the deformation-restricting wall 500, by which it tends not to deform in a direction along which it separates away from the supporting protrusion 146. Due to this, the second cutter 80 can be suppressed from being damaged for example with the coupling portion (first portion 154) between the cutting part 140 and the supporting peripheral portion 144 as a starting point of breakage.

In a variant, the first supporting part 138, the cutting part 140, the first coupling part 408 (see FIG. 18), and the second coupling part 410 (see FIG. 18) may be separate members. (Variants)

In an embodiment, the foregoing embodiments may be combined. For example, the cutting unit 36 in the first to sixth embodiments may comprise the deformation-restricting wall 500 of the seventh embodiment. Further, for example, in the first to fifth and seventh embodiments, the angle A1 formed by the first edge 162 and the second edge 166 may be an obtuse angle. Moreover, for example, in the first to third embodiments, the cutting part 140 and the supporting peripheral portion 144 may be coupled via the first coupling part 408 and the second coupling part 410 of the fourth embodiment, and the cutting part 140 and the second supporting part 142 may be coupled via the first coupling part 408 and the second coupling part 410 of the fourth embodiment.

In an embodiment, the second cutter 80 may cut the wire W by sliding linearly relative to the first cutter 78.

In an embodiment, the first cutter 78 may be configured to move relative to the body housing 14.

In an embodiment, the second cutter 80 may comprise only one of the first coupling part 408 and the second coupling part 410. Further, the second cutter 80 may further comprise one or more coupling parts other than the first coupling part 408 and the second coupling part 410.

What is claimed is:

1. A rebar tying tool configured to tie rebars with a wire, the rebar tying tool comprising:
- a feed unit comprising a feed roller configured to feed the wire toward the rebars;
- a first cutter;
- a second cutter configured to cut the wire by moving relative to the first cutter; and
- a twisting unit comprising a holder unit configured to twist the wire cut by the second cutter, wherein the second cutter comprises:
- a cutting part comprising a cutting edge configured to contact and cut the wire;
- a first connecting part connected to a first portion of the cutting part; and
- a second connecting part connected to a second portion of the cutting part, the second portion being different from the first portion, the second cuter further comprises a cutting hole, the cutting part is configured to cut the wire inserted into the cutting hole, the first connecting part comprises:

a peripheral portion directly connected to the cutting part, being spaced apart from the second connecting part, and facing the second connecting part; and a protrusion directly connected to the peripheral portion and the second connecting part, being spaced apart from the cutting part, and facing the cutting part, and the cutting hole constitutes a through hole surrounded by a first edge, a second edge, a third edge, and a fourth edge, which are respectively formed from the cutting part, the second connecting part, the peripheral portion, and the protrusion.

2. The rebar tying tool according to claim 1, wherein the first portion of the cutting part is disposed at one end of the cutting part, and the second portion of the cutting part is disposed at another end of the cutting part, the other end being opposite the one end.

3. The rebar tying tool according to claim 1, wherein a cross section of the cutting hole comprises:
- the first edge arranged in the cutting part and configured to contact and cut the wire,
- the second edge arranged in the second connecting part; and
- the third edge connecting the first edge and the second edge, and the third edge is curved.

4. The rebar tying tool according to claim 3, wherein the cross section of the cutting hole has a rectangular shape, and the second edge corresponds to a long side of the cross section of the cutting hole.

5. The rebar tying tool according to claim 3, wherein the second edge is substantially perpendicular to the first edge.

6. The rebar tying tool according to claim 1, wherein the cutting part, the first connecting part, and the second connecting part are integrally formed.

7. The rebar tying tool according to claim 1, wherein the second cutter is configured to rotate relative to the first cutter.

8. The rebar tying tool according to claim 1, wherein the through hole is surrounded and enclosed by:

the first edge,
- another first edge formed from the cutting part and opposite the first edge,
- the second edge,
- another second edge formed from the first connecting part and opposite the second edge,
- the third edge connecting the first edge and the second edge,
- another third edge connecting the first edge and the another second edge,
- the fourth edge connecting the another first edge and the second edge, and
- another fourth edge connecting the another first edge and the another second edge.

9. A rebar tying tool configured to tie rebars with a wire, the rebar tying tool comprising:
- a housing;
- a feed unit comprising a feed roller configured to feed the wire toward the rebars;
- a cutter configured to cut the wire by being rotated relative to the housing; and
- a twisting unit comprising a holder unit configured to twist the wire cut by the cutter, wherein the cutter comprises:
- a cutting part comprising a cutting edge configured to contact and cut the wire,
- a first supporting part connected to one end of the cutting part and configured to support the one end of the cutting part such that the one end of the cutting part is rotatable relative to the housing, and
- a second supporting part connected to another end of the cutting part and configured to support the other end of the cutting part such that the other end of the cutting part is rotatable relative to the housing, the first supporting part and the second supporting part receive a reaction force which the cutting part receives from the wire when the cutting part cuts the wire, the cutter further comprises a cutting hole, the cutting part is configured to cut the wire inserted into the cutting whole, the first supporting part comprises:

a peripheral portion directly connected to the cutting part, being spaced apart from the second supporting part, and facing the second supporting part; and a protrusion directly connected to the peripheral portion and the second supporting part, being spaced apart from the cutting part, and facing the cutting part, and the cutting hole constitutes a through hole surrounded by a first edge, a second edge, a third edge, and a fourth edge, which are respectively formed from the cutting part, the second supporting part, the peripheral portion and the protrusion.

10. A rebar tying tool configured to tie rebars with a wire, the rebar tying tool comprising:

a feed unit comprising a feed roller configured to feed the wire toward the rebars;

a first cutter;

a second cutter configured to cut the wire by moving relative to the first cutter; and a twisting unit comprising a holder unit configured to twist the wire cut by the second cutter, wherein the second cutter comprises:

a cutting part comprising a cutting edge configured to contact and cut the wire;

a connecting part connected to the cutting part; and at least one coupling part, one of the cutting part and the connecting part comprises at least one receiving part recessed toward inside of the one of the cutting part and the connecting part, and the connecting part is connected to the cutting part by each of the at least one receiving part receiving corresponding one of the at least one coupling part.

11. The rebar tying tool according to claim 10, wherein the other of the cutting part and the connecting part is integrally formed with the at least one coupling part, and each of the at least one coupling part protrudes outward from the other of the cutting part and the connecting part.

12. The rebar tying tool according to claim 10, wherein the cutting part comprises a cutting surface configured to contact and cut the wire, and the connecting part comprises a supporting surface connected to the cutting surface and substantially perpendicular to the cutting surface.

13. A rebar tying tool configured to tie rebars with a wire, the rebar tying tool comprising:

a feed unit comprising a feed roller configured to feed the wire toward the rebars;

a first cutter;

a second cutter configured to cut the wire by moving relative to the first cutter; and a twisting unit comprising a holder unit configured to twist the wire cut by the second cutter, wherein the second cutter comprises:

a cutting part comprising a cutting edge configured to contact and cut the wire;

a first connecting part connected to a first portion of the cutting part; and a second connecting part connected to a second portion of the cutting part, the second portion being different from the first portion, the second cutter further comprises a cutting hole defined by the cutting part, the first connecting part, and the second connecting part and constituting a through hole, the cutting part is configured to cut the wire inserted into the cutting hole, a cross section of the cutting hole comprises:

a first edge arranged in the cutting part and configured to contact and cut the wire, a second edge arranged in the first connecting part; and a third edge connecting the first edge and the second edge, and the third edge is curved.

* * * * *